US007501763B2

(12) United States Patent
Hashimoto et al.

(10) Patent No.: US 7,501,763 B2
(45) Date of Patent: Mar. 10, 2009

(54) GAS DISCHARGE DISPLAY PANEL

(75) Inventors: Jun Hashimoto, Osaka (JP); Masatoshi Kitagawa, Osaka (JP); Mikihiko Nishitani, Nara (JP); Masaharu Terauchi, Nara (JP); Shinichi Yamamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 210 days.

(21) Appl. No.: 10/594,145

(22) PCT Filed: Apr. 7, 2005

(86) PCT No.: PCT/JP2005/006884

§ 371 (c)(1),
(2), (4) Date: Sep. 26, 2006

(87) PCT Pub. No.: WO2005/098890

PCT Pub. Date: Oct. 20, 2005

(65) Prior Publication Data

US 2007/0216302 A1 Sep. 20, 2007

(30) Foreign Application Priority Data

Apr. 8, 2004 (JP) ..... 2004-113789
Jun. 2, 2004 (JP) ..... 2004-164952
Mar. 9, 2005 (JP) ..... 2005-065504

(51) Int. Cl.
*H01J 17/49* (2006.01)

(52) U.S. Cl. ..... 313/587; 313/582; 313/583; 313/584; 313/585; 313/586

(58) Field of Classification Search ..... 313/582–587; 315/169.4; 345/30, 37, 60; 445/24
See application file for complete search history.

(56) References Cited

U.S. PATENT DOCUMENTS

| | | | |
|---|---|---|---|
| 6,242,864 | B1 | 6/2001 | Nakahara et al. |
| 6,788,373 | B2 | 9/2004 | Ito et al. |
| 6,879,107 | B2 | 4/2005 | Hirano et al. |
| 2004/0070341 | A1 | 4/2004 | Chul Park |

FOREIGN PATENT DOCUMENTS

| | | |
|---|---|---|
| JP | 9-92133 | 4/1997 |
| JP | 9-295894 | 11/1997 |
| JP | 10-334809 | 12/1998 |

(Continued)

*Primary Examiner*—Nimeshkumar D. Patel
*Assistant Examiner*—Thomas A Hollweg

(57) ABSTRACT

Provided is a gas discharge display panel that exhibits a favorable display performance by maintaining a wall charge retaining power, controlling discharge delay within a range adequate for optimal image display, and reducing the discharge starting voltage at comparatively low cost. Also provided is a PDP that exhibits more reliability with enhanced display quality by further improving the secondary electron emission factor γ compared to conventional cases and lowering the discharge starting voltage to widen the driving margin. In addition, provided is a manufacturing method of a gas discharge display panel, by which the manufacturing cost lowers by reduction of the exhaustion time in the sealing exhaustion process, and by which the driving circuit cost is reduced. In the present invention, the protective layer contains, with respect to a MgO content of the protective layer, Si in a range of 20 mass ppm to 5000 mass ppm inclusive and H in a range of 300 mass ppm to 10000 mass ppm inclusive.

2 Claims, 12 Drawing Sheets

FOREIGN PATENT DOCUMENTS

| | | |
|---|---|---|
| JP | 2002-33053 | 1/2002 |
| JP | 2002-069617 | 3/2002 |
| JP | 2003-022755 | 1/2003 |
| JP | 2003-31136 | 1/2003 |
| JP | 2003-272533 | 9/2003 |
| JP | 2004-011014 | 1/2004 |
| JP | 2004-031264 | 1/2004 |
| JP | 2004-103273 | 4/2004 |
| JP | 2004-134407 | 4/2004 |

COMPARISON EXAMPLE a: STANDARD (ONLY MgO)

COMPARISON EXAMPLE b: Si-100ppm ADDED

COMPARISON EXAMPLE c: Si-1000ppm ADDED

EMBODIMETN EXAMPLE d: H-400ppm ADDED

EMBODIMETN EXAMPLE e: H-1000ppm ADDED

EMBODIMETN EXAMPLE f: H-1000ppm+Si-100ppm ADDED

EMBODIMETN EXAMPLE g: H-1000ppm+Si-500ppm ADDED

EMBODIMETN EXAMPLE h: H-1000ppm+Si-1000ppm ADDED

GAS DISCHARGE DISPLAY PANEL

TECHNICAL FIELD

The present invention relates to a gas discharge display panel such as a plasma display panel. The present invention particularly relates to a technology for improving a protective layer.

BACKGROUND ART

Gas discharge display panels, represented by a plasma display panel (herein after simply "PDP"), are display apparatuses that display images by light emission performed by exciting phosphors by means of ultraviolet light generated by gas discharge. According to the discharge forming method, PDPs are divided into two types of alternating current (AC) type and direct current (DC) type, where the AC type is most common because of superiority over the DC type in terms of brightness, light emission efficiency, and lifetime.

As is disclosed in Patent reference 1 for example, an AC-type PDP has the following structure. Two thin glass panels respectively provided with a plurality of electrodes (either display electrodes or address electrodes) and a dielectric layer are placed to oppose each other with a plurality of barrier ribs therebetween. A phosphor layer is provided so that phosphors are positioned between adjacent barrier ribs, thereby forming a plurality of discharge cells in matrix formation. The space between the two glass panels is filled with discharge gas. Furthermore, a protective layer (film) is provided on a surface of the dielectric layer covering the display electrodes.

While driving a PDP, power is supplied as necessary to the plurality of electrodes in a plurality of subfields that include an initialization period, an address period, a sustain period, and so on, according to a field time-sharing grayscale display method, thereby causing phosphor light emission by means of ultraviolet light generated by obtaining discharge in the discharge gas.

Here, a material for the protective layer provided for the front glass panel is required to generate discharge at a low discharge starting voltage while protecting the dielectric layer from ion bombardment incident to discharge at the same time. For this purpose, a material mainly made of magnesium oxide (MgO) is widely used for the protective layer of PDPs, as is disclosed in Patent reference 2, for MgO has an excellent sputtering resistant characteristic and a large secondary electron emission factor.

The conventional protective layer has the following problems.

The first problem is that conventional protective layers are susceptible to "discharge delay". The discharge delay is a phenomenon caused in the address period, which specifically corresponds to a time lag from application of a pulse for address discharge to when actual discharge to take place. If the discharge delay is large, the possibility of preventing address discharge from occurring even at the end of the address pulse application becomes high, with which writing defect is likely caused. This phenomenon is more frequent in high-speed driving. The problem of discharge delay is a problem to be solved for improving image display performance of PDPs.

So as to counter this problem of discharge delay, a technology was already proposed to reduce the time lag by adding a predetermined amount of Si to MgO, as is disclosed in Patent references 3 and 7, for example. Furthermore, Patent reference 4 discloses a technology of attempting to reduce the time lag by adding a predetermined amount of H to the protective layer. Still further, Patent reference 5 discloses a technology of attempting to reduce the time lag by adding Ge.

The second problem is a characteristic change of the protective layer.

To be more specific, a surface of the protective layer is exposed in the discharge space. However the metal oxide film such as the MgO film has a characteristic that absorbs gas such as water ($H_2O$) and carbon dioxide ($CO_2$), which then would easily generate hydroxide compounds and carbonate compounds. In a process performed in the air from among the PDP manufacturing processes, a protective layer made of MgO tends to be contaminated by absorption of oil impurity, $CO_2$, and $H_2O$. When the absorption gas is absorbed by the surface of the MgO, the characteristic of the protective layer changes, thereby decreasing the secondary electron emission efficiency. As a result, the discharge starting voltage is raised, narrowing the driving margin of a PDP.

Furthermore, according to the level of absorption of gas for example by the protective layer, the discharge starting voltage is varied for each discharge cell. This would lead to a problem of display defect called "black noise" which specifically is a phenomenon in which accurate display of intended cells is impaired.

Therefore conventionally, the protective layer has a two-layer structure, as disclosed by Patent reference 6 for example, to improve quality and enhance stability. The disclosure specifically discloses a two-layer structure in which a second protection film is provided on a first protection film, where the first protection film has a comparatively excellent discharge characteristic and is (111) oriented, and the second protection film has such a film characteristic that hardly absorbs gas and has small moisture absorption, thereby attempting to prevent absorption of water molecules and impurity gas such as $CO_2$.

Patent reference 1: Japanese Patent Publication No. H9-92133

Patent reference 2: Japanese Patent Publication No. H9-295894

Patent reference 3: Japanese Patent Publication No. H10-334809

Patent reference 4: Japanese Patent Publication No. 2002-33053

Patent reference 5: Japanese Patent Publication No. 2004-31264

Patent reference 6: Japanese Patent Publication No. 2003-22755

Patent reference 7: Japanese Patent Publication No. 2004-134407

DISCLOSURE OF THE INVENTION

Problem to be Solved by the Invention

However, the first problem can hardly be said to have been resolved at the current state.

Concretely, it is confirmed that the technology of Patent reference 3, although restraining generation of non-lighted area to some extent, produces a new problem of accentuating variations in discharge delay according to cells.

In addition, the inventors of the present invention have confirmed that the technology of Patent reference 4, although restraining discharge delay by addition of H to MgO, reduces retaining power of the wall charge, which makes it difficult to generate optimal discharge for image display.

Furthermore, measurement tests have revealed that the technology of Patent reference 5 has insufficient effect of restraining discharge delay as well as raising the discharge starting voltage. Accordingly, the technology of Patent reference 5 can hardly be said to produce a sufficient effect in obtaining excellent display qualities.

So as to treat the mentioned problems regarding protective layer, a possible method is to increase the operating voltage of a PDP while adopting a high resistance transistor and a driver IC as a driving circuit and an integrated circuit. However this method is not desirable in that it incurs high power consumption and high cost for PDPs.

Furthermore, the following problems are unsolved regarding the stated second problem.

In Patent reference 2 (the second conventional technology), if the material is exposed to the air in the PDP manufacturing processes, the protective layer absorbs unnecessary components such as $CO_2$ and water, thereby changing the characteristics of the protective layer. This deteriorates the secondary electron emission efficiency, thereby increasing the discharge starting voltage and narrowing the driving margin of the PDP.

With the technology of Patent reference 6, the secondary electron emission factor $\gamma$ is estimated to be about 0.2 at the maximum, which corresponds to a level obtainable by a conventional protective layer made of MgO having one-layer structure, although specific values for the secondary electron emission efficiency and the discharge starting voltage generated by using the two-layer protective layer structure are not disclosed in Patent reference 6. Accordingly, the discharge starting voltage according to Patent reference 6 is also estimated to be the same high level as that achieved in the conventional technologies.

Furthermore, if the characteristic of the protective layer changes, the discharge starting voltage while driving PDP would vary to cause black noises and affect the display quality and reliability.

A possible method for countering this problem is to perform an evacuator process, before discharge gas enclosure, to remove gas of adhered $CO_2$ and water. However PDPs have a structure in which a gap between the front panel and the back panel is narrow, and so an evacuation conductance is extremely small. As a result, the process takes comparatively long, and a different problem relating to the process cost can arise.

As stated above, there remain problems concerning gas discharge panels.

The present invention has been conceived in view of the above-stated problems. The first object of the present invention is to provide a gas discharge display panel that exhibits a favorable display performance by maintaining a wall charge retaining power, controlling discharge delay within a range adequate for optimal image display, and reducing the discharge starting voltage at comparatively low cost.

The second object of the present invention is to provide a PDP that exhibits more reliability with enhanced display quality by further improving the secondary electron emission factor $\gamma$ compared to conventional cases and lowering the discharge starting voltage to widen the driving margin. The second object of the present invention is further to provide a manufacturing method of a gas discharge display panel, by which the manufacturing cost lowers by reduction of the exhaustion time in the sealing exhaustion process, and by which the driving circuit cost is reduced.

Means to Solve the Problems

So as to solve the above-stated problems, the present invention provides a gas discharge display panel including a substrate, a dielectric layer, and a protective layer, the dielectric layer and the protective layer being formed in the stated order on a surface of the substrate, where the protective layer contains H in a range of 300 mass ppm to 10000 mass ppm inclusive with respect to a MgO content of the protective layer.

Here, the H content of the protective layer may be in a range of less than 1500 mass ppm with respect to the MgO content.

Here, the protective layer may further contain Si in a range of 20 mass ppm to 5000 mass ppm inclusive with respect to the MgO content.

Or, the protective layer may further contain Ge in a range of 10 mass ppm or above and below 500 mass ppm with respect to the MgO content.

The present invention also provides a gas discharge display panel including a substrate, a dielectric layer, and a protective layer, the dielectric layer and the protective layer being formed in the stated order on a surface of the substrate, in which when the protective layer is subjected to a cathodoluminescence spectroscopy, a relative area intensity of a first intensity with respect to a second intensity for a light emission peak area is in a range of 0.6 to 1.5 inclusive, where the first intensity is a light emission peak intensity generated in a wavelength range of 720 nm or above and below 770 nm and the second intensity is a light emission peak intensity generated in a wavelength range of 300 nm or above and below 450 nm.

Here, the protective layer may contain H in addition to MgO.

In addition, a structure is possible in which the protective layer contains H and Si in addition to MgO, where the Si content is in a range of 20 mass ppm to 5000 mass ppm inclusive with respect to the MgO content.

In addition, the present invention provides a gas discharge display panel including a substrate, a dielectric layer, and a protective layer, the dielectric layer and the protective layer being formed in the stated order on a surface of the substrate, in which when the protective layer is subjected to a cathodoluminescence spectroscopy, a relative area intensity of a second intensity with respect to a third intensity for a light emission peak area is in a range of 0.9 or above, where the second intensity is a light emission peak intensity generated in a wavelength range of 450 nm or above and below 600 nm and the third intensity is a light emission peak intensity generated in a wavelength range of 300 nm or above and below 450 nm.

Here, the protective layer may contain H in addition to MgO.

Furthermore, a structure is also possible in which the protective layer contains H and Ge in addition MgO, where the Ge content is in a range of 10 mass ppm to 300 mass ppm inclusive with respect to the MgO content.

The protective layer may contain Ge in a range of 10 mass ppm or above and below 300 mass ppm with respect to the MgO content.

Advantageous Effect of the Invention

The inventors of the present invention have been dedicated to finding a method of solving the conventional problem of discharge delay in the address period. As a result, the inventors have found that the problem is solved by making a protective layer by including, in the main component of MgO, Si, or Ge respectively in the above-defined content ratio, and optionally H.

According to the protective layer having the stated structures, by the addition of the Si, Ge, and H respectively in an adequate amount to MgO, it becomes possible to produce such advantageous effects as enabling to control the discharge delay in an optimal range without lowering the wall charge retaining power at the time of driving, and to dramatically and effectively prevent the occurrence of writing defect during the address period. Furthermore, the protective layer having the stated structures also lowers the discharge starting voltage.

In addition, the present invention has another advantage of being realized in comparatively low cost, because of the structure of merely adding Si, Ge, and optionally H respectively in an adequate amount to MgO.

BEST MODE FOR CARRYING OUT THE INVENTION

The following describes embodiments the present invention, with use of the drawings.

First Embodiment 1-1. Structure of PDP

FIG. 1 is a partial perspective view showing a main structure of an AC-type PDP 1, according to the first embodiment of the present invention. In the drawing, the z-direction corresponds to a thickness direction of the PDP 1, and the xy plane corresponds to a plane parallel to the surface of the panels of the PDP 1. Here, the PDP 1 has an NTSC specification of 42 inches for example. However needless to say, the present invention is also applicable to other specifications, including XGA, and SXGA. The present invention is also applicable to other sizes.

As FIG. 1 shows, the PDP 1 is mainly structured by a front panel 10 and a back panel 16 whose main surfaces are opposed to each other.

On one main surface of the front panel glass 11 that is a substrate of the front panel 10, a plurality of pairs of display electrodes 12 and 13 (scan electrode 12 and sustain electrode 13) are provided. Each display electrode 12, 13 is formed by stacking bus lines 121 and 131 (having thickness of 7 μm, and width of 95 μm) made of an Ag thick film (having thickness of 2 μm-10 μm), an aluminum (Al) thin film (having thickness of 0.1 μm-1 μm), or a Cr/Cu/Cr thin film (having thickness of 0.1 μm-1 μm) onto belt-like transparent electrodes 120, 130 (having thickness of 0.1 μm, and width of 150 μm) made of a transparent conductive material such as ITO and $SnO_2$. The bus lines 121, 131 lower sheet resistance of the transparent electrodes 120, 130.

The front panel glass 11 provided with the display electrodes 12, 13 is provided with a low-melting glass dielectric layer 14 (having a thickness of 20 μm-50 μm) on an entire main surface of the front panel glass 11 in a screen printing method and the like. The dielectric layer 14 is mainly composed of lead oxide (PbO), bismuth oxide ($Bi_2O_3$), or phosphorus oxide ($PO_4$). The dielectric layer 14 has a current control function typical of an AC-type PDP, which helps obtain a long life compared to a DC-type PDP. A protective layer 15 having a thickness of about 1.0 μm is coated on a surface of the dielectric layer 14.

The first embodiment is characterized by a structure of the protective layer 15, which is detailed as follows.

On one main surface of the back panel glass 17 that is a substrate of the back panel 16, a plurality of address electrodes 18 are arranged in a stripe formation with a distance (360 μm) therebetween in y-direction where x-direction is a lengthwise direction. Each address electrode 18 has a width of 60 μm and is made of Ag thick film (thickness of 2 μm-10 μm), aluminum (Al) thin film (thickness of 0.1 μm-1 μm), or Cr/Cu/Cr thin film (thickness of 0.1 μm-1 μm). A dielectric layer 19 having a thickness of 30 μm is coated onto the back panel glass 17 so as to cover the address electrodes 18.

Further on the dielectric layer 19, barrier ribs 20 (height of about 150 μm and width of 40 μm) are provided in-between the address electrodes 18. Cell SUs are divided by adjacent barrier ribs 20, and function to prevent occurrence of erroneous discharge or optical crosstalk in the x-direction. A corresponding one of phosphor layers 21-23 is formed on side surfaces of each of the barrier ribs 20 and a surface of the dielectric layer 19 therebetween, where the phosphor layers 21-23 respectively correspond to red (R), green (G), and blue (B) for color display.

It is alternatively possible to cover the address electrodes 18 directly with the phosphor layers 21-23, instead of the dielectric layer 19.

The front panel 10 and the back panel 16 are provided to oppose each other so that the lengthwise direction of the address electrodes 18 is orthogonal to the lengthwise direction of the display electrodes 12, 13. The circumference of the two panels 10 and 16 is sealed with a glass frit. Between the panels 10 and 16, a discharge gas (sealing gas) made of an inert gas component such as He, Xe, and Ne, and the like is sealed with a predetermined pressure (normally approximately with a pressure of 53.2 kPa-79.8 kPa).

A discharge space 24 is formed between any two adjacent barrier ribs 20. Each area where a pair of display electrodes 12, 13 cross over one address electrode 18 with the discharge space 24 therebetween corresponds to one cell SU. Note that a cell is occasionally called "sub-pixel", too. The pitch of a cell is 1080 μm in x-direction and 360 μm in y-direction. Three adjacent cells SU each corresponding to RGB form one pixel (1080 μm×1080 μm).

1-2. Driving Method of PDP

The PDP1 having the above-stated structure is driven in the following way. A driving unit not illustrated in the drawings applies an AC voltage of about some tens of kHz to some hundreds of kHz to each gap created between a pair of display electrodes 12, 13, thereby generating discharge within the cells SU. Excited Xe molecules emit ultraviolet light to excite the phosphor layers 21-23. As a result, visible light is emitted.

One example of the driving method is a field time-sharing grayscale display method. In this display method, a display field is divided into a plurality of subfields. Each subfield is further divided into a plurality of periods. In each subfield, wall charge accumulated in the entire screen is initialized (i.e. reset) during the initialization period. In the address period, address discharge is performed with respect to only discharge cells to be lit to accumulate wall charge to the discharge cells to be lit. In the discharge sustain period that follows, an alternating current voltage (sustain voltage) is simultaneously applied to all the discharge cells, to sustain discharge for a certain period of time. In this way, light emission display is realized.

In this driving method, the driving unit divides each of the fields F into six subfields for example for the purpose of representing light emission in each cell by a binary control of ON/OFF, where the fields F are arranged chronologically and are images input from outside. Brightness of the subfields are weighted so that the relative ratio will be for example 1:2:4:8:16:32, thereby setting the number of times of light emission with respect to sustain (sustain discharge) of each subfield.

Here, FIG. 2 is one example of a driving wave form process of the present PDP1. FIG. 2 specifically shows a wave form of the m-th subfield within the fields. As FIG. 2 shows, each subfield is assigned an initialization period, an address period, a discharge sustain period, and a deletion period.

The initialization period is for performing initialization discharge, and is for deleting wall charge of the entire screen for preventing an effect of prior illumination of each cell (i.e. for preventing an effect from accumulated wall charge). In the wave form example of FIG. 2, a reset pulse in a descending lamp wave form of a positive polarity that exceeds the discharge start voltage Vf is applied to all the display electrodes 12, 13. Simultaneously, a positive-polarity pulse is applied to all the address electrodes 18 for preventing charging and ion bombardment from occurring at the back panel 16 side. By a voltage differential between ascending and descending of an application pulse, initialization discharge that specifically is a weak surface discharge takes place in every cell, thereby accumulating wall discharge in every cell. As a result, the entire screen will be brought in a uniform charging state.

The address period is for performing addressing (i.e. setting of illumination/non-illumination) to cells selected based on an image signal divided into subfields. In this address period, with respect to the ground potential, the scan electrodes 12 are biased towards the positive potential, and the sustain electrodes 13 are biased towards the negative potential. While keeping this state, a scan pulse of a negative polarity is applied to the scan electrodes 12 one by one from the top line positioned in the upper end of the panel, where each line corresponds to one horizontal sequence of cells and also corresponds to one pair of display electrodes. In addition, to address electrodes 18 that correspond to cells to be lit, an address pulse of a positive polarity is applied. With this arrangement, while inheriting the weak surface discharge of the initialization period, address discharge is performed only in the cells to be lit, thereby accumulating wall charge.

The discharge sustain period is for sustaining discharge, for the purpose of assuring the brightness in accordance with grayscale, by enlarging the illumination state set in advance by the address discharge. Here, all the address electrodes 18 are biased to a positive potential for preventing unnecessary discharge. At the same time, a sustain pulse of a positive polarity is applied to all the sustain electrodes 13. Thereafter, a sustain pulse is alternately applied to the scan electrodes 12 and the sustain electrodes 13, so as to repeat discharge for a certain time period.

The deletion period is for deleting the wall charge by applying a declining pulse to the scan electrodes 12.

Note that the lengths of the initialization period and the length of the address period are respectively constant regardless of the brightness weight. Meanwhile the length of the discharge sustain period is longer as the weight of the brightness gets larger. In other words, the length of display period is different among the subfields.

In the PDP1, vacuum ultraviolet light composed of a resonance line having an acute peak at 147 nm attributable to Xe and molecule lines centered around 173 nm are generated. The vacuum ultraviolet light is irradiated onto each of the phosphor layers 21-23, thereby generating visible light. Then by a combination of each color of RGB in each subfield, a display in multicolor and multi-grayscale is realized.

The first embodiment is characterized by a structure of the protective layer 15 in the PDP1.

The protective layer 15 in the first embodiment is mainly composed of MgO. Besides, the protective layer 15 contains impurity (dopant) of Si in the range of 20 mass ppm to 5000 mass ppm inclusive, and H in the range of 300 mass ppm to 10000 mass ppm inclusive. According to the structure of the protective layer 15 that includes a predetermined amount of the mentioned impurity, the PDP1 is able to have an increased amount of electrons from the protective layer 15 which would contribute to discharge, thereby realizing an effect of restricting occurrence of discharge delay. In addition, even if the discharge delay is caused, variation in time of delay is restrained, which would lead to realization of an excellent image display performance.

As follows, this characteristic is described in greater detail.

Characteristic and Advantageous Effect of First Embodiment

Conventional PDPs sometimes cannot obtain an adequate image display attributable to writing defect based on the discharge delay in the address period while being driven. However the PDP of the present invention is able to solve this problem effectively by adding H to MgO that constitutes the protective layer, and optionally adding thereto Si or Ge in an adequate amount, as stated above.

To be more specific, in the present invention, occurrence of discharge delay is restrained by promoting emission of electrons from the protective layer that contribute to discharge, and the retaining power of the wall charge is maintained thereby restraining writing defect. As a result, address discharge and succeeding sustain discharge are normally executed, thereby realizing a favorable image display performance.

In addition, if the discharge delay is caused in the present invention while the PDP is being driven, the variation in discharge delay time (discharge variability) is restrained compared to conventional PDPs, and the level of discharge variability is averaged. By alleviating the discharge variability in this way, the present invention has another advantageous effect of effectively preventing the occurrence of writing defect due to discharge delay in a drastic manner, by adopting measures such as delaying a timing of pulse application during the address period for the entire panel for a predetermined time period for example.

Accordingly, the PDP1 of the present invention is able to perform assured addressing, and so can perform addressing with a favorable probability with even a little smaller application pulse width during the address period. This further means that even without adopting a conventional dual scan method, a favorable driving is enabled by adopting a driving method such as a so-called single scan method which is mandated to reduce the number of driver IC to half. For this reason, the present invention has other advantages such as simplifying the structure of the driving unit and realizing production at low cost.

The present invention produces advantageous effects of restraining discharge variability, and of further realizing both of restraining of discharge delay and maintaining the retaining power of wall charge, which can not be realized by the conventional technologies such as Patent references 3, 4, and 5. The inventors of the present invention have found the above-described structure as an effective solution by performing examination in view of how to cope with such problems of discharge variability, discharge delay, and wall charge retaining power maintenance.

Next, data obtained in performance comparison tests using embodiment examples is detailed as follows.

Embodiment Examples and Confirmation Test for Advantageous Effect Thereof

FIG. 3 illustrates a graph for showing compositions of a protective layer and a relative size of a variation in discharge delay time (discharge variability). In this drawing, data relating to protective layers having the following structures is presented with the discharge variability of a conventional protective layer solely made of MgO being assumed as 100%.

Si added protective layer (comparison example 2):

100 mass ppm of Si is added to MgO.

Si+H added protective layer (first embodiment):

100 mass ppm of Si, and 1000 mass ppm of H are added to MgO.

H added protective layer (second embodiment):

1000 mass ppm of H is added to MgO.

From the data in FIG. 3, the protective layer (comparison example 2) with only Si addition in comparatively a small amount to MgO is considered as undesirable because the value of discharge variability is 114% which indicates performance deterioration even compared to the conventional case. The comparison example 2 corresponds in structure to Patent reference 7 described above. The data also shows that the technology of Patent reference 3 is not suitable in obtaining favorable image display performance in reality.

On the other hand, the embodiment example 1 (first embodiment) in which a predetermined amount of Si and a predetermined amount of H is added to MgO is able to restrain discharge variability approximately down to 31% with respect to the comparison example 1. This confirms that the embodiment example 1 has an effect of averaging the discharge delay time among a plurality of cells. Furthermore, in a case (embodiment example 2) where the protective layer is created by adding only H in a strictly defined amount to MgO, an effect of reducing the discharge variability approximately down to 54% was obtained with respect to the comparison example 1. This confirms that the embodiment example 2 also produces a sufficient level of the advantageous effect of the present invention.

FIG. 4 shown next illustrates intensity of discharge variability for each of a conventional protective layer made only of MgO (i.e. comparison example "a", or the comparison example 1), comparison examples "b" and "c", in which a predetermined amount of Si is added to MgO, and embodiment examples "d" "e" "f" "g" and "h" in which a predetermined amount of H and optionally a predetermined amount of Si are added.

In the embodiment examples and the comparison examples shown in FIG. 4, the embodiment example f which contains 100 mass ppm of Si and 1000 mass ppm of H is confirmed as the best structure in restraining the discharge variability. As the content of Si gets larger than in this embodiment example f, it is confirmed that the discharge variability increases (e.g. as shown in embodiment examples g and h). Accordingly, so as to obtain higher performance than the comparison example a in the context of the present invention, adequate content of H and optionally Si with respect to MgO should be defined. The specific ranges of H and Si are detailed later.

As is clear from the test results, it is expected that the structure of the present invention produce an effect of alleviating the discharge variability and averaging the level of discharge variability compared to the conventional cases. As a result, even if discharge delay is caused in the address period, it is still possible to perform assured addressing either by delaying the application timing of address pulse or setting a pulse width in concurrence with the discharge delay time, thereby realizing a favorable image display performance.

Next, FIG. 5 is a graph showing a composition of the protective layer, discharge delay (in relative value), and a wall charge retaining power index. In this drawing, the discharge delay and the wall charge retaining power index are assumed to be 1 under a condition that the image quality does not have any practical problem. In addition, if the discharge delay is 1 or below, and if the wall charge retaining power index is 1 or above, the image quality is assumed to be within an allowable range. In other words, a product is considered favorable when the following conditions are satisfied: "discharge delay <1" and "wall charge retaining power index >1". Data shown in FIG. 5 relates to the protective layers having the following structures respectively.

Conventional MgO (comparison example 1):

MgO with no impurity addition

H-added MgO (Comparison example 2):

2000 mass ppm of H is added to MgO

H+Ge-added MgO (Embodiment example 1):

50 mass ppm of Ge and 2000 mass ppm of H are added to MgO

Ge-added MgO (1) (embodiment example 2):

50 mass ppm of Ge is added to MgO

Ge-added MgO (2) (comparison example 3):

1000 mass ppm of Ge is added to MgO

From the data of FIG. 5, in the protective layer (comparison example 2) produced by adding only H to MgO, discharge delay is restrained, but the wall charge retaining power is deteriorated. Accordingly, a protective layer having this structure is considered undesirable because of having comparatively lowered performance. This comparison example 2 corresponds in structure to Patent reference 4. From the data, it is understood that favorable image display performance is not expected in reality from the technology of Patent reference 4.

On the other hand, with the embodiment example 1 (first embodiment) in which H in a predetermined amount and Ge in a predetermined amount are added to MgO, the discharge delay caused is within the optimal range with respect to the image display, and has not experienced any practical problem with respect to the wall charge retaining power either.

In addition, if a protective layer is structured by adding only Ge in a strictly defined amount to MgO (embodiment example 2), it is confirmed that the effect of the present invention is sufficiently realized.

However, in a case where a protective layer is produced by adding only 1000 mass ppm of Ge to MgO (comparison example 3), the discharge delay exceeds the allowable range for obtaining favorable images, as FIG. 5 shows. This means that the probability of generating address discharge during the address pulse application is lowered, which would likely lead to writing defect.

As is clear from the above test results, the structure of the present invention enables to control display delay within the optimal range for image display while maintaining the wall charge retaining power. As a result, it becomes possible to obtain a favorable image display performance by preventing occurrence of writing defect during the address period. The necessary content of H and Ge in the present invention is detailed later.

Next, with respect to protective layers 15 having different discharge variability, a cathode luminescence is measured during PDP driving, and a relation between light emission spectrum and discharge variability which is peculiar to the protective layer, is examined. The cathodoluminescence (CL) spectroscopy is an analysis method for detecting a light emission spectrum as an energy alleviating process incident to irradiation of an electron to a sample, thereby knowing whether there is any defect within the sample (i.e. protective layer) and information such as its structure.

FIG. 6 shows data regarding the test results of the cathodoluminescence spectroscopy. FIG. 6 is for showing a relation between a light emission wavelength and light emission intensity, with the horizontal axis representing a light emission wavelength, and the vertical axis representing light emission intensity. The samples are specifically as follows:

Sample A: (MgO+Si+H), embodiment example

Sample B: (MgO+400 mass ppm of H)

Sample C: (only MgO)

Sample D: (MgO+1000 mass ppm of Si)

The measurement conditions are as follows.

Electron accelerating voltage: 5 kV

Filament current density: $2.4\times10^8$ (A/cm$^2$)

FIG. 6 shows relative values of discharge variability 31, 74, 100, and 184, respectively for the samples A, B, C, and D in the stated order, with a respective spectrum wave form for a corresponding protective layer. For each spectrum, substantially three peaks (light emission wavelength of about 410 nm, about 510 nm, and about 740 nm) are observed. The value of wavelength for each peak is correlated with defective energy existing in the band gap of the protective layer. From this relation, it is understood that, as the light emission wavelength at about 740 nm gets larger, a larger number of electrons is emitted from the protective layer that contribute to discharge, and that the expected effect of restraining the discharge variability is large.

Note that only a relative value of the luminous intensity in the context of each wave form has meaning, and an absolute value of the luminous intensity does not have any special meaning.

For each protective layer of the embodiment examples (samples A and B), a clear peak is observed for each light emission wavelength. In particular, the peaks at about 740 nm light emission wavelength are larger for the samples A and B than those for the other samples C and D. From this, it is estimated that even if a protective layer contains Si in addition to MgO, if the amount of Si is not adequate, the protective layer cannot produce an optimal effect. The same thing applies to a protective layer that contains H.

Next, FIG. 7 shows a relation between the discharge variability of a protective layer and a relative area intensity at a peak light emission wavelength of about 740 nm relative to the peak intensity at a peak light emission wavelength of about 410 nm, regarding the cathodoluminescence spectroscopy. From the left of the horizontal axis corresponding to small discharge variability, data respectively of samples A, B, C, and D is shown in this order.

As can been seen from the relative area intensity for the samples A and B in FIG. 7, the value of the relative area intensity should be desirably in the range of 0.6 to 1.5, inclusive, for the purpose of obtaining smaller discharge variability than in the conventional structures (samples C and D). If the relative area intensity becomes 1.5 or above, the carrier concentration of the protective layer becomes too large thereby reducing the insulation resistance. This is not desirable because then the retaining power of wall charge is expected to decrease.

Note that the wavelength inherently has variations to some extent. Therefore in reality, suppose classifying the light emission peak intensity generated in the wavelength range of 720 nm to 770 nm inclusive as a first intensity, and the light emission peak intensity generated in the wavelength range of 300 nm to 450 nm inclusive as a second intensity. Then it is desirable that the relative area intensity of the first intensity with respect to the second intensity for the light emission peak area is in the range of 0.6 to 1.5 inclusive.

FIG. 8 shows a relation between a discharge starting voltage of a protective layer and relative area intensity of the peak light emission wavelength at about 510 nm with respect to the peak light emission wavelength at about 410 nm, regarding the cathodoluminescence spectroscopy. From the left of the horizontal axis corresponding to small discharge starting voltage, samples are shown in the order shown below:

Sample E: (MgO+50 mass ppm of Ge+1200 mass ppm of H)

Sample F: (MgO+50 mass ppm of Ge)

Sample G: (MgO+1200 mass ppm of H)

Sample H: (only MgO, conventional structure)

The measurement conditions are as follows.

Electron accelerating voltage: 5 kV

Filament current density: $6.3\times10^5$ (A/cm$^2$)

Here, the reason why the current density is different from the measurement conditions of FIGS. 6 and 7 is that the present measurement of FIG. 8 is performed using a different apparatus, and so the spot diameter of the electrons differs largely from the example of FIGS. 6 and 7.

As is understood by FIG. 8, if the value of the relative area intensity is 0.9 or above, the discharge starting voltage is reduced compared to the conventional structure (i.e. sample D). Note that the wavelength inherently has variations to some extent. Therefore in reality, suppose classifying the light emission peak intensity generated in the wavelength range of 450 nm or above and below 600 nm as a second intensity, and the light emission peak intensity generated in the wavelength range of 300 or above and below 450 nm as a third intensity. Then it is desirable that the relative area intensity of the second intensity with respect to the third intensity is in the range of 0.9 or above.

Furthermore, as long as the relative area intensity is 0.9 or above for the protective layer of the present invention, the same effect as stated above is expected regardless of whether the dopant is a combination of Ge and H, or solely Ge.

Concretely, the same effect is expected for a protective layer in which H is diffused in MgO with respect to the Ge content that is in the range of 10 mass ppm to 300 mass ppm inclusive, or a protective layer in which only Ge in the range of 10 mass ppm or above and below 300 mass ppm is diffused in MgO. Data regarding such an embodiment example of adding an adequate amount of Ge to MgO is shown as the embodiment example 2 in FIG. 5.

Next, the amount of H and Si necessary in the present invention is detailed below.

<Amount of H and Si to be Added with Respect to MgO>

Next, the following shows the result of examinations performed by the inventors of the present invention regarding the components of the protective layer from which the effect of the present invention is obtainable effectively.

Here, the content of Si in the protective layer 15 can be examined by a secondary ion mass spectrometry method (SIMS method).

On the other hand, the content of H in the protective layer 15 can be examined using a hydrogen forward scatting method (HFS method).

As stated above, discharge variability is examined by changing the contents of H and Si to be added. As a result, in the protective layer that contains both of Si and H in addition to MgO, the content of the Si is preferably in the range of 20 mass ppm to 10000 mass ppm inclusive.

Furthermore, it is confirmed that, if the content of Si is in the range of 50 mass ppm to 1000 mass ppm inclusive, the effect of restraining discharge variability is particularly prominent. From FIG. 4, discharge variability is small in the embodiment examples f, g, and h that respectively have a Si content of 100 mass ppm, 500 mass ppm, and 1000 mass ppm. Consequently, discharge variability is considered small if the content of Si is in the range of 50 mass ppm to 1000 mass ppm inclusive.

When the Si content is smaller than 20 mass ppm, it is confirmed that the discharge delay restraining effect is extremely small. Conversely, if the Si content becomes larger than 5000 mass ppm, the discharge variability becomes extremely large, and crystallinity of the protective layer is confirmed to be adversely affected according to the result of the x-ray diffraction measurement method and the like.

On the other hand, as a result of the examination using the HFS, it is confirmed that the H content to be added together with silicon in the above-stated structure of the protective layer is desirably in the range of 300 mass ppm to 10000 mass ppm inclusive.

Note that when the Si content becomes smaller than 20 mass ppm, it is confirmed that the discharge delay restraining effect gets extremely small. Conversely, if the Si content becomes larger than 5000 mass ppm, the discharge variability becomes extremely large, and that crystallinity of the protective layer is confirmed to be adversely affected according to the result of the x-ray diffraction measurement method and the like.

Furthermore, it is confirmed that the H content in the range of 1000 mass ppm to 2000 mass ppm, inclusive is preferable, for the discharge delay restraining effect is in particular obtainable.

Additionally in this case, if the H content becomes smaller than 300 mass ppm, it is undesirable because the effect of H addition becomes extremely small. Conversely, if the H content becomes larger than 10000 mass ppm, it is also undesirable because the carrier concentration of the protective layer becomes too large to degrade the insulation resistance, and further to degrade the wall charge retaining power.

Furthermore, in the present invention, the protective layer in which an adequate amount of H is added to MgO just as in the embodiment examples d and e in FIG. 4 obtains substantially the same effect as the effect obtained by the protective layer that contains a predetermined amount of Si and a predetermined amount of H.

The above data shows that the preferable amount of H atoms to be added to MgO together with Si is in the range of 300 mass ppm to 10000 mass ppm inclusive.

Next, the amount of H and Ge to be added in the protective layer, which is necessary in the present invention, is detailed below.

Amount of H and Ge to be Added with Respect to MgO

Next, the following shows the result of examinations performed by the inventors of the present invention regarding the components of the protective layer from which the effect of the present invention is effectively obtainable.

Here, the content of Ge in the protective layer 15 can be examined by a secondary ion mass spectrometry method (SIMS method).

On the other hand, the content of H in the protective layer 15 can be examined using a hydrogen forward scatting method (HFS method).

First, examination is performed based on the SIMS. The result shows that for the protective layer in which both Ge and H are added to MgO, the preferable range of the Ge content is 10 mass ppm or above and below 500 mass ppm.

Furthermore, if the Ge content is within the range of 20 mass ppm to 100 mass ppm inclusive, it is confirmed that the image display quality is particularly excellent.

Note that if the Ge content becomes smaller than 10 mass ppm, it is confirmed that the wall charge retaining power becomes extremely small. Conversely, if the Ge content becomes larger than 500 mass ppm, the discharge delay becomes extremely large, and the crystallinity of the protective layer is confirmed to be adversely affected according to the result of the x-ray diffraction measurement method and the like.

On the other hand, examination based on the HFS reveals that the preferable range of the H content to be added with Ge in the protective layer having the above-mentioned structure is 300 mass ppm to 10000 mass ppm inclusive.

The result further shows that if the H content is in the range of 1000 mass ppm to 2000 mass ppm inclusive, it is preferable since the effect of restraining discharge delay occurrence is particularly obtainable.

In this case, if the H content becomes smaller than 300 mass ppm, it is undesirable because the effect of H addition becomes extremely small. Conversely, if the H content becomes larger than 10000 mass ppm, it is also undesirable because the carrier concentration of the protective layer becomes too large to degrade the insulation resistance, and further to degrade the wall charge retaining power.

So far, the description has been restricted, as embodiment examples, to protective layers in which H and either Si or Ge are added to MgO. However, the present invention may alternatively take a structure in which only H is added to MgO, and in which the H atom content is set in the range of 300 mass ppm to 10000 mass ppm inclusive. Furthermore, in the protective layer in which only H is added to MgO, another experimental data reveals that that it is desirable to set an amount of H atoms to be added in the range of 300 mass ppm or above and less than 1500 mass ppm.

<Manufacturing Method of PDP>

As follows, one example of manufacturing methods of PDP 1 according to the first embodiment is described. The following explanation also includes an example method of forming a protective layer of the present invention.

(Manufacturing Front Panel)

Display electrodes are formed on a surface of the front panel glass made of soda lime glass having a thickness of about 2.6 mm.

The following shows a method that uses a printing method. However a dye coating method, or a blade coating method may also be used.

An ITO (transparent electrode) material is applied on the front panel glass in a predetermined pattern, and is dried. On the other hand, a photosensitive paste is created by mixing a photosensitive resin (i.e. photodegradable resin) to metal (Ag) powders and the organic vehicle. This photosensitive paste is applied onto the transparent electrode material, and is covered with a mask having a pattern of the display electrodes to be formed. Light exposure is performed over the mask, and then a development process is performed. Then, a burning process is performed at a burning temperature of about 590-600 degrees Celsius. As a result, bus lines are formed on the transparent electrodes. According to this photomask method, the bus lines can be made thin to the level of a line width of about 30 μm, compared to a conventional screen printing method by which a line width of 100 μm is the thinnest. Note that the metal material of the bus lines may be alternatively Pt, Au, Ag, Al, Ni, Cr, tin oxide, and indium oxide, for example.

In addition, the electrodes are also formable by forming a film using an electrode material using an evaporation method, a sputtering method, and the like, and then by performing etching.

Next, above the formed display electrodes, a paste created by mixing dielectric glass powders mainly made of oxide lead or bismuth oxide having a softening temperature in the range of 550-600 degrees Celsius and an organic binder made of butyl carbitol acetate and the like is applied, and is baked at a temperature of about 550-650 degrees Celsius, thereby completing a dielectric layer.

Next, on the surface of the dielectric layer, a protective layer having a predetermined thickness is formed by an EB (electron beam) evaporation method. In this way, the protective layer 15 containing an adequate amount of Si or Ge of the present invention is formed by the EB evaporation method.

The source used in the evaporation for forming the protective layer is for example prepared by mixing a Si compound or a Ge compound either in pellet or powder form, with MgO in pellet form, for example. It is also possible to prepare a source by mixing MgO in powder form with either a Si compound or a Ge compound in powder form. Still alternatively, the mentioned mixtures may be sintered before completion. The concentrations of the Si compound and the Ge compound are respectively set as 20-10000 mass ppm and 5-700 mass ppm. Then in the oxygen atmosphere, the evaporation source is heated using a pierce-type electron beam gun as a heating source to form a desired film. Here, the electron beam current amount, oxygen partial pressure amount, a substrate's temperature, and the like used in forming the film hardly affects the composition of a resulting protective layer, and therefore can be set arbitrarily.

Once the film made of MgO is formed, in an atmosphere containing H, the MgO film is subjected to plasma processing. For example, in a doping chamber of H atoms, a substrate is heated using a heater to 100-300 degrees Celsius, and the chamber is evacuated until the vacuum level reaches $1\times10^{-4}$-$7\times10^{-4}$ Pa. After this, Ar gas is introduced while controlling the vacuum level to $6\times10^{-1}$ Pa. Next, while introducing H gas at a current amount of $1\times10^{-5}$-$3\times10^{-5}$ $m^3$/min, a high frequency source is used to apply a high frequency of 13.56 MHz thereby generating discharge within the doping chamber of H atoms.

Then, plasma is generated by exciting H atoms by means of this discharge. Then the protective layer 15 already, formed on the substrate is exposed to the excited H for 10 minutes, thereby performing H atom doping to the protective layer 15.

Note that the layer forming method is not limited to the EB (electron beam) evaporation method, and may alternatively be a sputtering method, and an ion plating method, for example.

The front panel completes as a result of the above-described processes.

(Manufacturing Back Panel)

Address electrodes having a thickness of about 5 μm are formed on a surface of the back panel glass made of soda lime glass having a thickness of about 2.6 mm, by applying a conductive material mainly composed of Ag using a screen printing method in stripe formation with a predetermined distance therebetween. Here, so as to have the PDP 1 to comply with the NTSC standard or VGA standard of 40-inch classes, it is required to set a distance between adjacent address electrodes as about 0.4 mm or below.

Next, a glass paste mainly made of lead is applied with a thickness of about 20-30 μm on an entire surface of the back panel glass to which the address electrodes have been formed, and then baked, thereby completing a dielectric layer.

Next, using the same lead glass material as is used for the dielectric layer, barrier ribs having a height of about 60-100 μm are formed between the adjacent address electrodes. The barrier ribs are for example formed by repeatedly applying the paste containing the glass material using a screen printing method, and thereafter baking it. Note that in the present invention, it is desirable to include a Si component in the lead glass material making the barrier ribs, for the purpose of restraining the impedance increase of the protective layer. This Si component may either be included in the chemical composition of the glass or added to the glass material. In addition, an adequate amount of an impurity (dopant) (e.g. N, H, Cl, F) having high vapor pressure may be added in gas form, in the vapor phase while forming an MgO film.

After the barrier ribs complete, a phosphor ink containing one of red (R) phosphor, green (G) phosphor, and blue (B) phosphor is applied on side surfaces of adjacent barrier ribs and a surface of the dielectric layer exposed between the barrier ribs, and is dried and baked, thereby completing a phosphor layer.

One example of the chemical composition of the phosphor having colors of RGB is as follows:

Red phosphor: $Y_2O_3$, $Eu^{3+}$

Green phosphor: $Zn_2SiO_4$:Mn

Blue phosphor: $BaMgAl_{10}O_{17}$:$Eu^{2+}$

Each phosphor material has an average particle diameter of 2.0 μm for example. A corresponding one of such phosphor material is placed in a server in a ratio of 50 mass %. In the server, 1.0 mass % of ethyl cellulose and 49 mass % of a solvent (α-terpineol) are also thrown. The mixture is then subjected to agitation mixture using a sand mill, thereby completing a phosphor ink of $15\times10^{-3}$ Pa·s. Then the phosphor ink is injected from a nozzle having a diameter of 60 μm using a pump, so as to be applied in-between adjacent barrier ribs 20. During this operation, the panel is moved in the lengthwise direction of the barrier ribs 20, to facilitate application of the phosphor ink in stripe formation. After this operation, the resulting panel is baked at the temperature of 500 degrees Celsius for ten minutes, thereby completing the phosphor layers 21-23.

The back panel completes as a result of the above-described processes.

Note that the front panel glass and the back panel glass are described above as being made of soda lime glass. However this is one example, and other materials may be used.

(Completing PDP)

The front panel glass and the back panel glass manufactured as above are attached to each other using glass for sealing. After this, the discharge space is evacuated to a level of high vacuum state ($1.0\times10^{-4}$ Pa), and discharge gas of Ne—Xe, He—Ne—Xe, Ne—Xe—Ar, or the like is enclosed with a predetermined pressure (here, a pressure of 66.5 kPa-101 kPa).

The PDP 1 completes as a result of the above processes.

Next, modification examples of forming the protective layer, which are different from the above-described example method, are listed as follows, regarding the manufacturing method of the PDP.

Modification Example 1

In the present modification example 1, first, a film mainly composed of MgO and additionally containing Si or Ge is formed using the method described in the first embodiment.

Then, means for generating H ion is used as a method of doping the H atoms to the film, thereby irradiating H ion on the surface of the formed film.

Here, the setting conditions are as follows for example: using a heater, the substrate is heated to the temperature of 100-300 degrees Celsius within the doping chamber of H atoms, and the chamber is evacuated until the vacuum level reaches $1\times10^{-4}$-$7\times10^{-4}$ Pa.

After this, H ions are irradiated onto the protective layer 15 having been formed on the substrate using an ion gun linked to the H container, thereby doping H atoms of the protective layer 15. The amount of flowing for H is set in the range of $1\times10^{-5}$-$3\times10^{-5}$ $m^3$/min.

Modification Example 2

In the modification example 2, first a film made of MgO is formed using the method described in the first embodiment. Then the formed film is placed in a chamber. While the film is being subjected to plasma processing in the atmosphere containing H, and an evaporation source created by mixing a Si compound and a Ge compound is heated using an electron beam gun, thereby completing a protective layer containing H and either Si or Ge.

Modification Example 3

In the modification example 3, first, a film made of MgO is formed using the method described in the first embodiment. Then the formed film is placed in a chamber. While H ion is being irradiated to the substrate using an ion gun linked to an H container, an evaporation source created by mixing a Si compound and a Ge compound is heated using an electron beam gun, thereby completing a protective layer containing H and Si.

<Other Notes>

The forming method of the protective layer of the gas discharge display panel according to the present invention is not limited to each of the examples stated above, and other methods such as a sputtering method and an ion plating method or the like may be alternatively used.

Second Embodiment

FIG. 9 is a sectional conceptual diagram showing a structure around a front panel of a PDP according to the second embodiment. The basic structure of the PDP is the same as that described in the first embodiment, except that the structure of the protective layer 15 is different therebetween. In the second embodiment, the protective layer 15 has a first protective film 151 and a second protective film 152 that is laminated on the first protective film 151, where the first protective film 151 contains impurity in larger amount than the impurity contained in the second protective film 152 that is genuine. "Impurity" here is for example H, Cl, and F, which is able to activate MgO by forming a dangling bond. The film thickness of the first protective film 151 is about 600 nm and the film thickness of the second protective film 152 is about 30 nm, for example.

The first protective film 151 manufactured in this way is more activated than in conventional cases, and is a little more apt to absorb gas that contains unnecessary component such as carbon incorporated during the manufacturing processes than in conventional cases. However, the first protective film 151 is expected to improve the secondary electron emission factory compared to the conventional cases. As a result, the first protective film 151 is expected to improve the performance. In other words, since being an activated film formed by doping a MgO film with a large amount of impurity, the first protective film 151 has an improved secondary electron emission efficiency compared to a conventional protective layer made of MgO, and is further able to decrease a discharge starting voltage.

As stated above, a protective layer 15 in the present embodiment is formed by a first protective film 151 and a second protective film 152 that is laminated onto an entire surface of the first protective film 151. In addition, the first protective film 151 is larger in impurity content than the second protective film 152. As a result, during processes performed in the atmospheric air, the protective layer 15 is prevented from absorbing gas containing unnecessary component, and the discharge starting voltage is reduced in large amount to widen the driving margin, thereby enabling the PDP to exhibit more reliability with enhanced display quality free from black noise.

In fact, the experiments conducted using embodiment examples created according to the second embodiment reveal as follows. The protective layer 15 of the PDP has a further improved secondary electron emission efficiency compared to a protective layer of the conventional one-layer structure or to a protective layer of the two-layer structure disclosed in Patent reference 1. In fact, the protective layer 15 according to the second embodiment has a secondary electron emission factor $\gamma$ of about 0.3, and a discharge starting voltage of about 120V where the conventional value thereof is 180V, which proves enlargement of a driving margin.

Furthermore, the PDP having the above-stated protective layer is proved to have a reduced variation in discharge starting voltage of the discharge cells and have a largely reduced display defect attributable to black noise.

Another confirmation test regarding the second embodiment is described as follows. FIG. 12 shows a result of XPS data obtained by examining water absorption content of the protective layer mentioned above (herein after "protective layer 1") after being left to stand in the atmospheric air, where the MgO film of the protective layer is controlled to incorporate impurity therein. In the example of FIG. 12, another protective layer (herein after "protective layer 2") whose MgO film is of high purity in a sense of incorporating no impurity therein is also used for comparison purposes. The test was conducted by leaving to stand these two protective layers 1 and 2 in the atmospheric air, or by performing thermal processing to the two protective layers 1 and 2 at the temperature of 500 degrees Celsius for two hours.

As is clear from FIG. 12, the water absorption content of the protective layer 1 incorporating impurity therein is larger than that of the protective layer 2 incorporating no impurity therein.

From this result, it is considered possible to carry out the present invention stated above with more effectiveness and stability, by means of the following embodiment examples that attempt to solve the problem of gas absorption.

(Manufacturing Method)

An example of the manufacturing processes of the protective layer 15 according to the second embodiment is explained as follows.

Overall, the protective layer 15 is manufactured by forming a first protective film 151 made of MgO on an entire surface of the dielectric layer 14 with use of a sputtering method that is used for the first embodiment, an electron beam evaporation method, or a CVD (chemical vapor deposition) method, and then by forming a second protective film 152 made of metal oxide being a high purity MgO to cover an entire surface of the first protective film 151.

(a) First of all, display electrodes 12, 13 are provided on a surface of the front panel glass 11. Then a dielectric layer is formed onto the surface of the front panel glass 11 to cover the display electrodes 12, 13.

(b) After this process, Ar ions in plasma state are sputtered to MgO target, using a sputtering apparatus. As a result, a first protective film 151 with a film thickness of about 600 nm is formed on a surface of the dielectric layer 14.

In the manufacturing process (b), by forming the first protective film 151 while introducing $H_2$ gas into the Ar gas, H is doped as impurity in the first protective film 151. As a result, the MgO film that is to be the first protective film 151 is activated by means of formation of so-called dangling bond, and the secondary electron emission factor γ improves compared to the other are as of the protective layer (i.e. or compared to a protective layer having a conventional structure).

Here, "dangling bond" is unsaturated bond of an atom group that surrounds a certain lattice defect ("oxygen defect" in this case) found in the vicinity or inside a film surface. The dangling bond is apt to catch or absorb an impurity gas atom such as electrons and carbons generated during a manufacturing process. Note here that the adequate range of H impurity content in the first protective film 151 is $1\times10^{18\text{-}23}/cm^3$. The impurity dope amount should be taken care of. If the impurity dope amount becomes too small, the secondary electron emission factor γ goes down to the conventional level. On the contrary, if the impurity dope amount becomes too large, the film resistance becomes too low, to make it hard to retain wall charge that corresponds to written data.

(c) Next, in the sputtering apparatus, the high impurity MgO target is sputtered by means of Ar gas, thereby forming the second protective film 152, being a MgO film, with a film thickness of about 30 nm. According to this method, the resulting second protective film 152 does not absorb so much gas that contains unnecessary components during the processes. Such a second protective film 152 is able to greatly reduce the amount of impurity emitted between the panels by covering absorbed impurity such as carbon owing to impurity gas absorbed in the first protective film 151.

Concretely, during the manufacturing processes, the emission amount of gas containing unnecessary component incident to the exhaustion processes is reduced to about ⅕ of the amount resulting when adopting the conventional method. This indicates that during the processes performed in the atmospheric air, the protective layer is dramatically prevented from absorbing gas containing unnecessary component. As a result, a time required for exhaustion during panel sealing is reduced to about ½.

In addition, by forming the second protective film on an entire surface of the first protective film, it becomes possible to lower the manufacturing cost by reducing the time required for exhaustion during the sealing exhaustion process in PDP manufacturing. At the same time, it is possible to lower the driving voltage according to the manufacturing method of PDP. Consequently, the resulting PDP is expected to have a lowered driving circuit cost by lowering the driving voltage.

Note that in the above description, impurity to be incorporated in the first protective film is explained to be H. However alternatively, the impurity may be Cl, F, which can form a dangling bond, or a combination therebetween. The film is formable by mixing these gasses into Ar gas.

In addition, the film thickness of the first protective film is explained to be about 600 nm, and the film thickness of the second protective film is explained to be about 30 nm. However, the film thicknesses of the first and second protective films are respectively adjusted as long as they fall within the range of 10 nm-1 μm. Preferably, however, the second protective film should be thin with respect to the first protective film so that the second protective film can be removed by sputtering as a result of discharge in the initial stage of the discharge after the PDP completes after sealing. The second protective film is preferably in the range of 10 nm to 100 nm. If the second protective film is thin such as about 10 nm, the film can be formed evenly on a predetermined area. However the film thickness falls outside this range, the resulting film sometimes becomes scattered in island-like formation.

Third and Forth Embodiments

FIGS. 10A and 10B are respectively a sectional diagram and a plan conceptual diagram showing a schematic structure of a discharge cell around the front panel, regarding the third embodiment.

As shown in these drawings, a second protective film 153 of a protective layer 15 is formed in stripe formation on a surface of a first protective film 151, where BaO is used as a base material of both of the first protective film 151 and the second protective film 153. The area ratio of an overlapping part of the second protective film 153 with the display electrodes 12, 13 is about 30% with respect to the width W of each one display electrode 12, 13.

FIGS. 11A and 11B are respectively a sectional diagram and a plan conceptual diagram showing a schematic structure of a discharge cell around the front panel. In the fourth embodiment, a first protective film 151 made of BaO is formed on a surface of the dielectric layer 14, and a second protective film 154 is formed thereon so that the first protective film 151 is exposed in fence-like formation. The area ratio of an overlapping part of the second protective film 154 with the display electrodes 12, 13 is about 80% with respect to the width W of each one display electrode 12, 13.

The film thickness of the first protective film is set in the range of 10 nm-1 μm. The film thickness of the first protective film is for example set as about 600 nm. On the other hand, the film thickness of the second protective film is set as in the range of 10 nm to 100 nm inclusive, which is thinner than the film thickness of the first protective film.

Here, in the first protective film 151, Si is doped as impurity with a concentration range of $1\times10^{18\text{-}23}/cm^3$. The material for doping is not limited to Si, and may be at least one of H, Cl, F, Ge, and Cr.

Note that the first protective film and the second protective film are both formable using a metal oxide material that contains at least one of MgO, CaO, BaO, SrO, MgNO, and ZnO, as a base material.

When the third and fourth embodiments having the stated structures are driven, the electrons in the second protective films 153 and 154 of a high purity are excited and activated up to the vicinity of the conductive zone, thereby realizing high secondary electron emission efficiency. In addition, the first protective film 151 in which Si and the like is doped helps reduce the incorporation of unnecessary gas component into the protection layer, and so it becomes possible to reduce the amount of the gas component to be emitted in the discharge space. As a result, the protective layer 15 as a whole is endowed with high functionality.

Here, the tests conducted using the embodiment examples having the structure of the third embodiment have proved that the third embodiment has substantially the same effect as those of the first and second embodiments. Furthermore, it is proved that the protective layer 15 of the third embodiment has further improved secondary electron emission factor γ, which is about 0.32. As a result, the discharge starting voltage is largely reduced to the level of about 115V in comparison to the conventional value of 180V, confirming the enlargement of driving margin.

In addition, the measurement test conducted using the embodiment examples of the fourth embodiment has also confirmed the excellent effects being substantially the same as those of the embodiment examples of the third embodiment.

(Manufacturing Method)

(a) After forming the dielectric layer 14, a BaO film is formed in a sputtering apparatus under a condition where the atmospheric air is blocked. By forming a BaO film by blocking the air in this way, unnecessary gas such as $CO_2$ and $H_2O$ is prevented from entering the BaO film.

Here, a high purity MgO target is sputtered within the Ar gas in the sputtering apparatus via a metal mask (not shown in the drawing), thereby forming a genuine BaO film.

In addition, Ar ions in plasma state are sputtered onto the BaO target in which Si is mixed. As a result, a first protective film 151 having a film thickness of about 600 nm is formed on a surface of the dielectric layer 14.

Here, the Si impurity content is desirably in the range of $1\times10^{18\text{-}23}/cm^3$. If the dope amount of the impurity is too small, the secondary electron emission efficiency becomes the same level as in the conventional cases. If the dope amount becomes too large, the film resistance becomes too low, thereby making it difficult to retain wall charge that corresponds to written data. According to this adjustment, the first protective film 151, which is made of a BaO film more activated than conventionally, can further improve the second electron emission efficiency than MgO, although becoming apt to absorb unnecessary impurity gas such as carbon generated during the manufacturing processes.

(b) Next, on the surface of the first protective film 151, second protective films 153 and 154 are formed in a predetermined pattern. This is for example performed by sputtering the high purity MgO target within the Ar gas in the sputtering apparatus via a metal mask (not shown in the drawing) for which a predetermined patterning has been provided.

Then the second protective films 153 and 154 of the genuine MgO film are formed with a film thickness of about 50 nm. Here, the second protective films 153 and 154 are formed so that a ratio of their respective area under a corresponding display electrode 12 is a predetermined value with respect to a width W of the display electrode 12.

Note that the second protective film 154 may also be formed in irregular pattern such that its portions scatter in island-like formation, with a thickness in the range of 10 nm to 30 nm inclusive.

In addition, if the second protective film is formed on the first protective film so that at least part of the first protective film under a corresponding display electrode be exposed, a time required for exhaustion is reduced in the sealing exhaustion process in the PDP manufacturing, thereby reducing manufacturing cost. In addition, this arrangement is able to lower the driving voltage thereby enabling a manufacturing method of PDP by which a driving circuit cost is reduced.

In addition, in the above explanation, the protective layer is formed using a sputtering method. However alternatively, an electron beam evaporation method, a CVD method, a combination of the methods may be used too. However, it is at least desirable to form the first protective film using the sputtering method, for the purpose of further improving the second electron emission efficiency and the sputtering resistant characteristics of the resulting protective layer.

INDUSTRIAL APPLICABILITY

A gas discharge panel according to the present invention is applicable to a large-size television, a high-definition television, or a large-size display apparatus. Accordingly, the gas discharge panel according to the present invention is applicable in a film-related apparatus industry, an advertisement apparatus industry, and industries dealing with industrial apparatuses and other apparatuses.

Explanation Of Reference Signs

Figure 1:
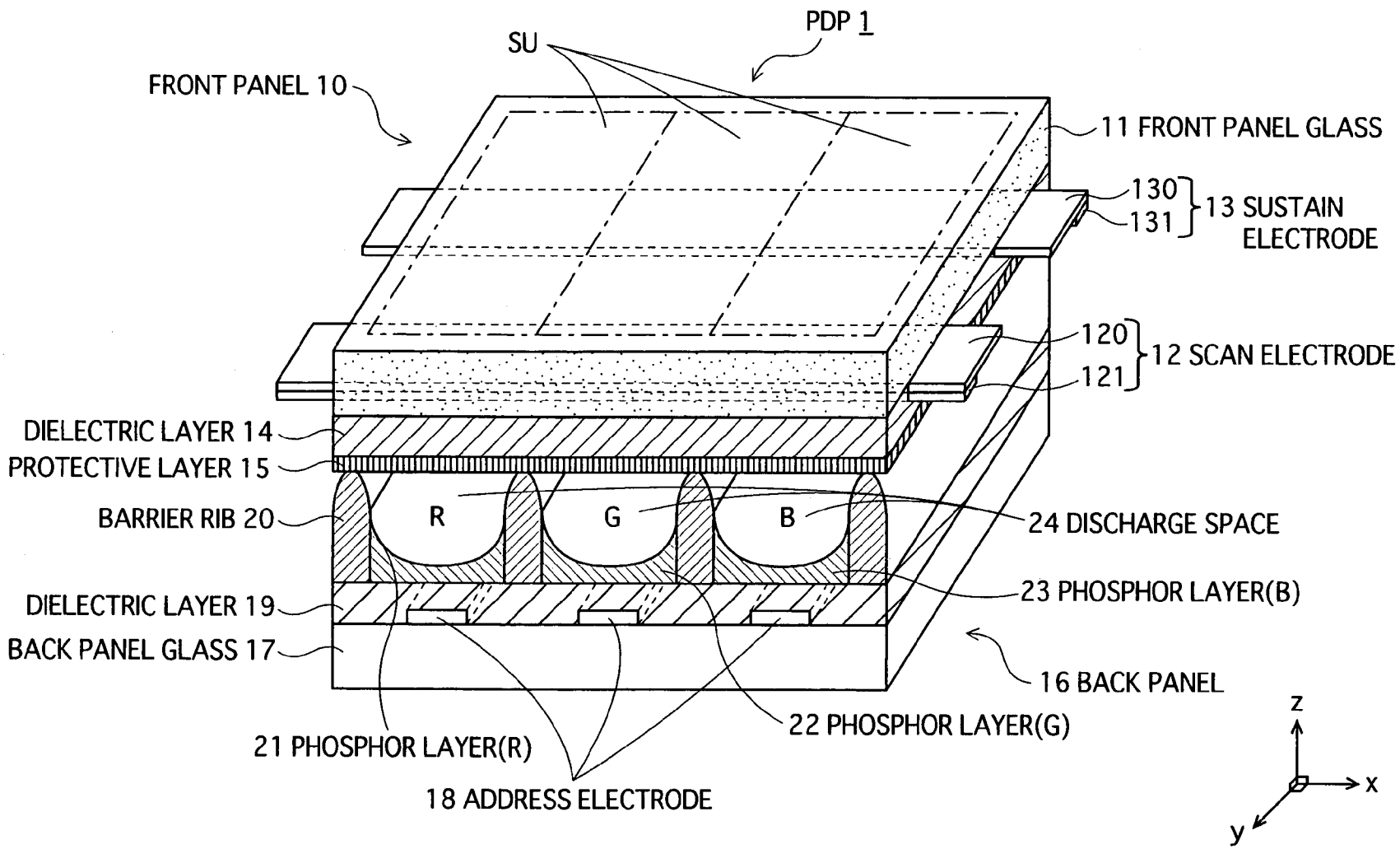
FIG. 1 is a sectional perspective diagram showing a structure of a PDP according to the first embodiment.
Figure 2:
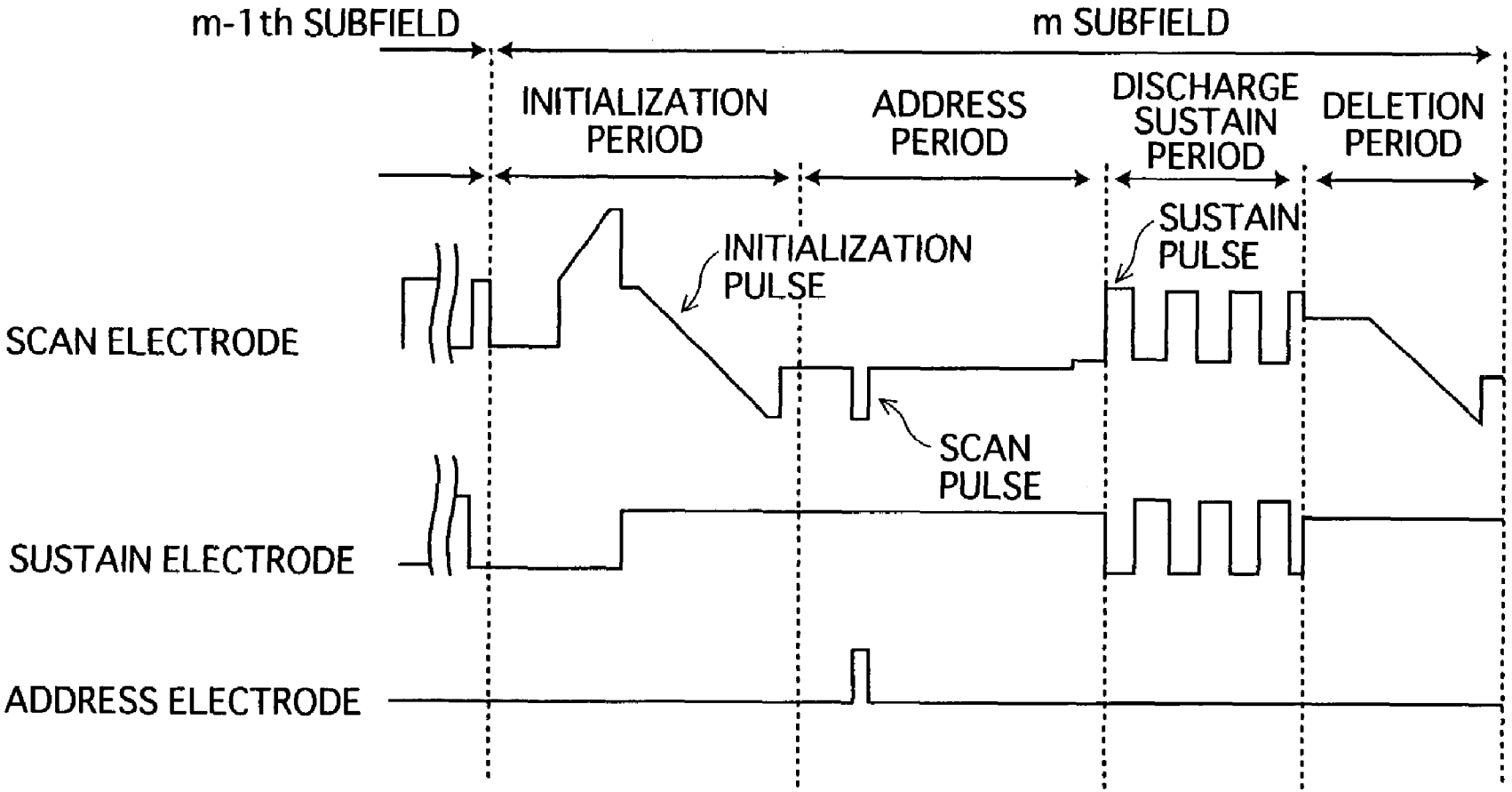
FIG. 2 is a diagram showing an example of driving processes of the PDP.
Figure 3:
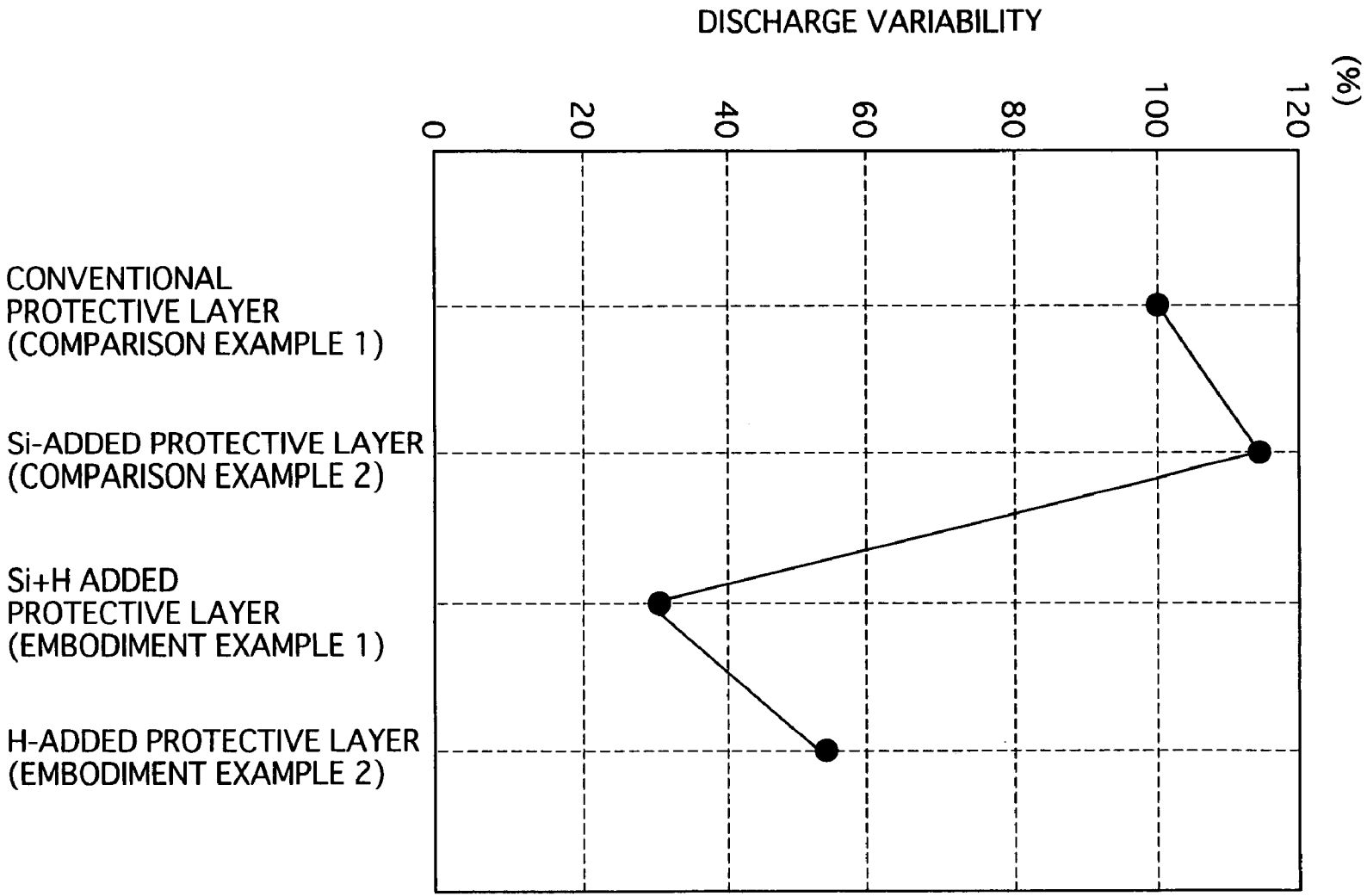
FIG. 3 is a graph showing a relation between compositions of a protective layer and discharge variability.
Figure 4:
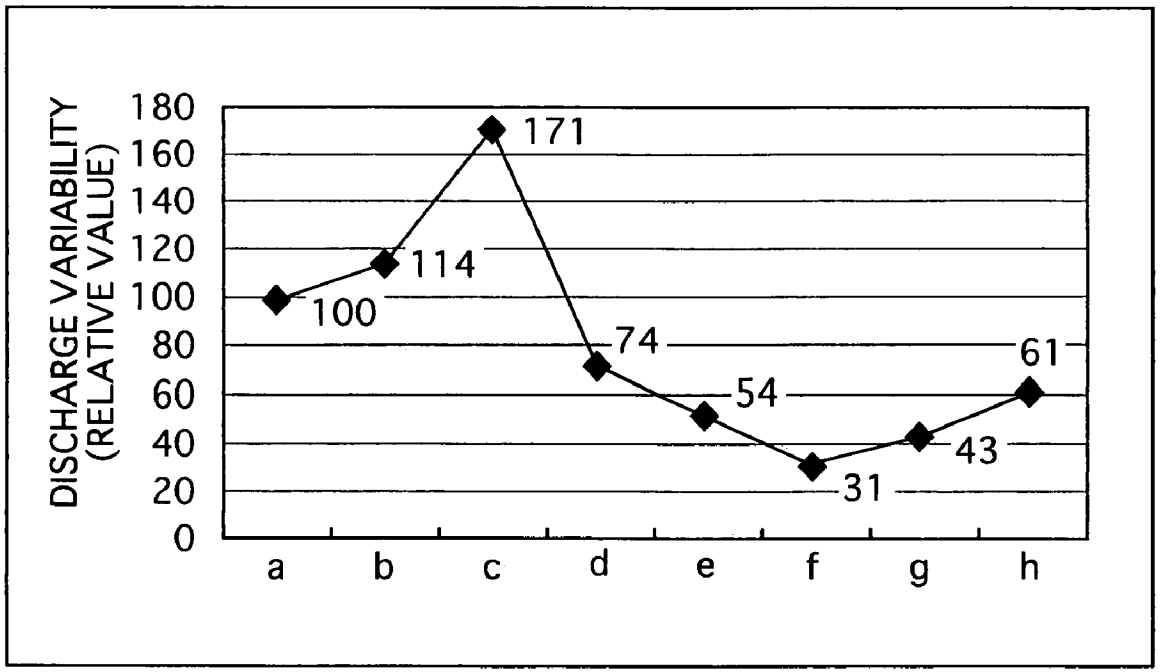
FIG. 4 is a graph showing a detailed relation between compositions of a protective layer and discharge variability.
Figure 5:
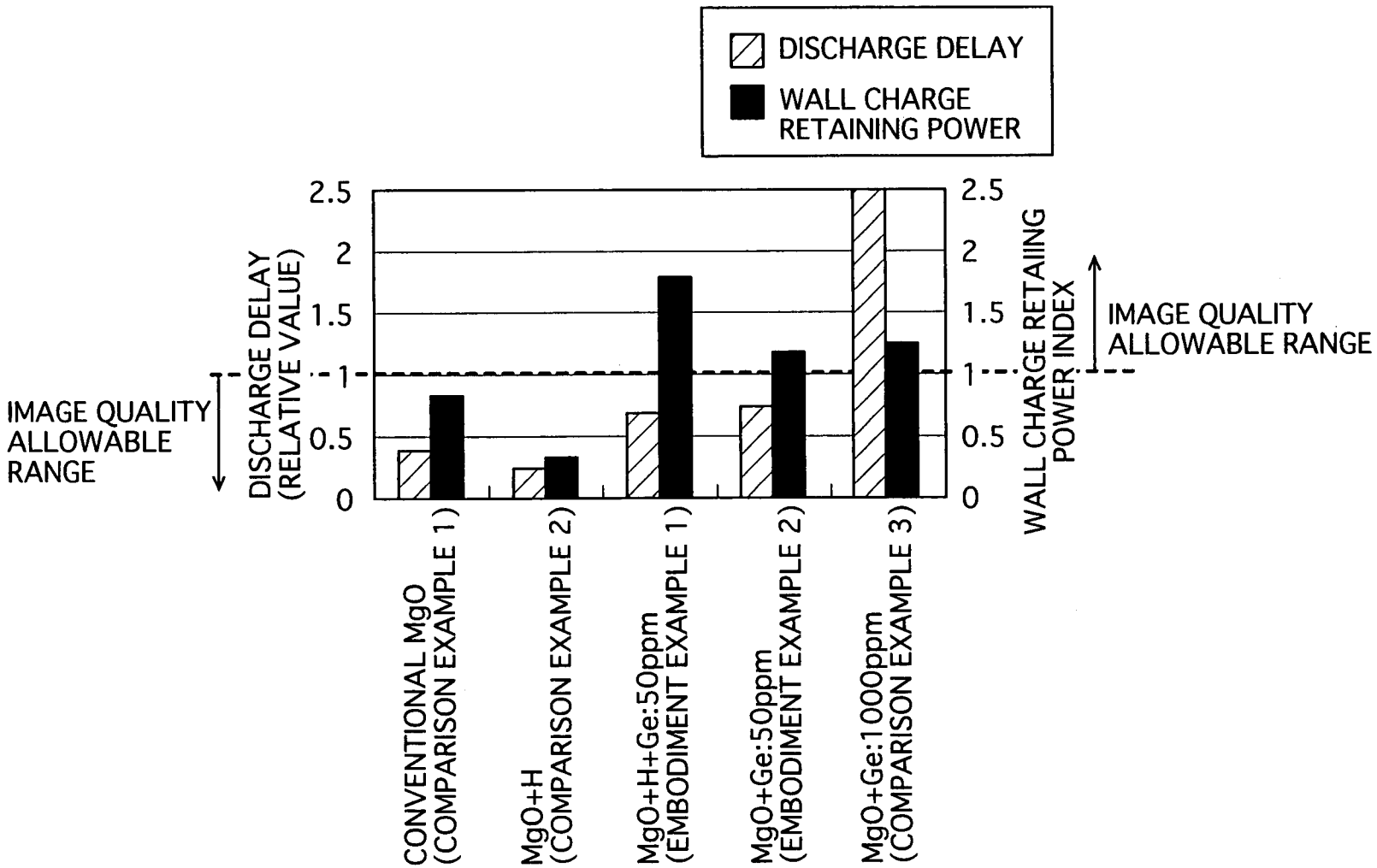
FIG. 5 is a graph showing a relation between compositions of a protective layer, discharge delay, and wall charge retaining power index.
Figure 6:
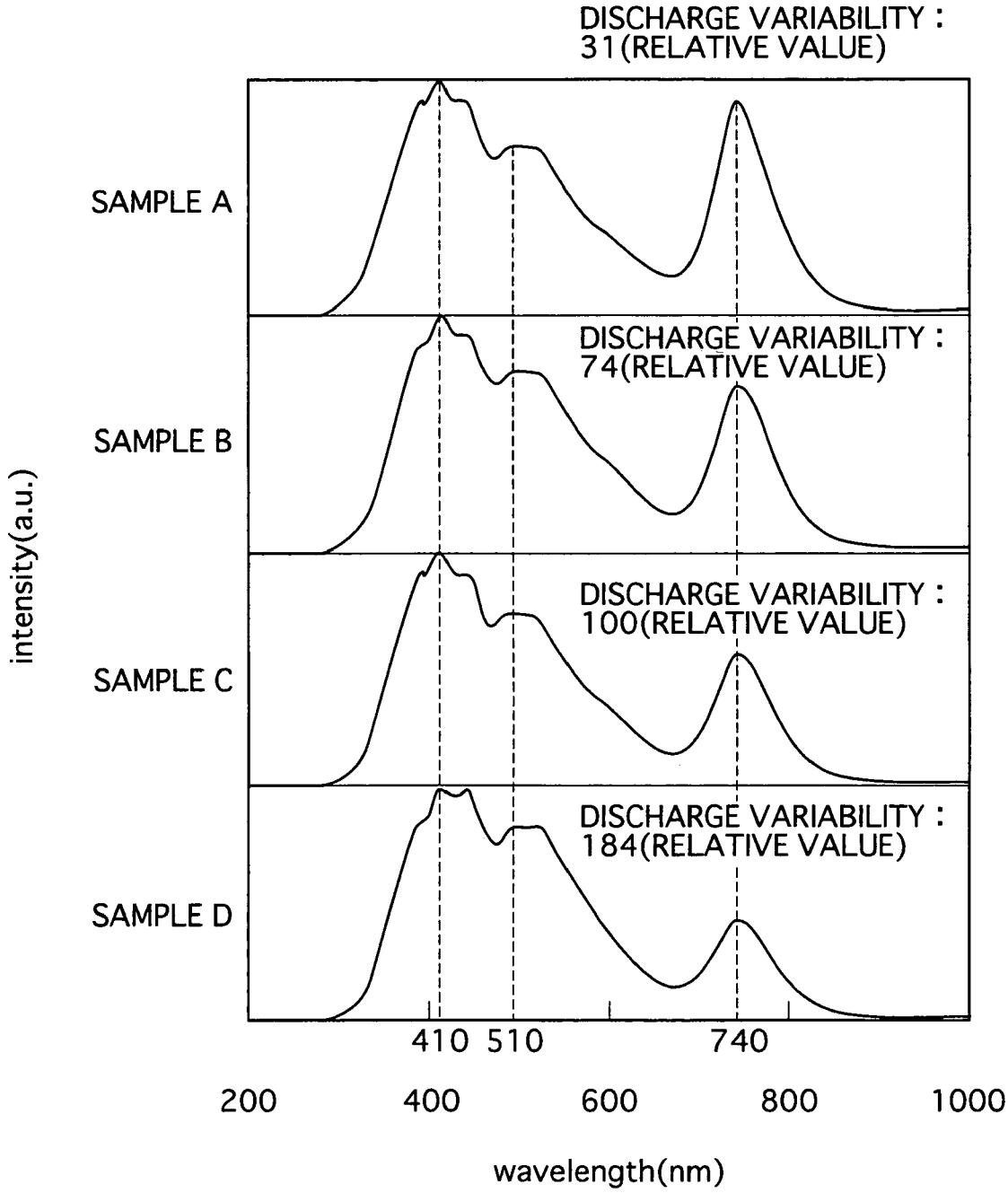
FIG. 6 is a graph showing a relation between a light emission wavelength and light emission intensity in cathodoluminescence spectroscopy.
Figure 7:
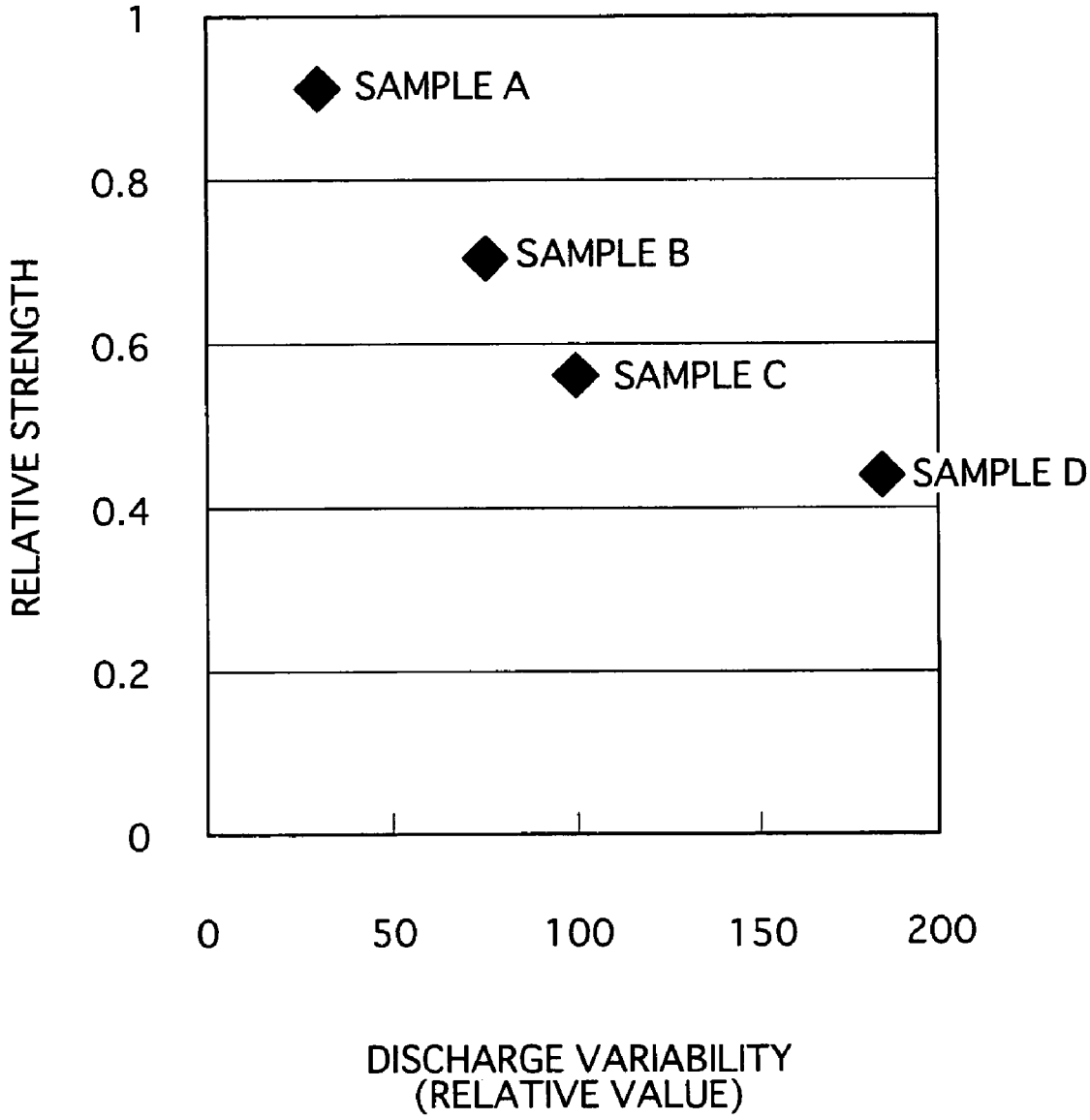
FIG. 7 is a graph showing a relation between discharge variability and light emission intensity in cathode luminescence.
Figure 8:
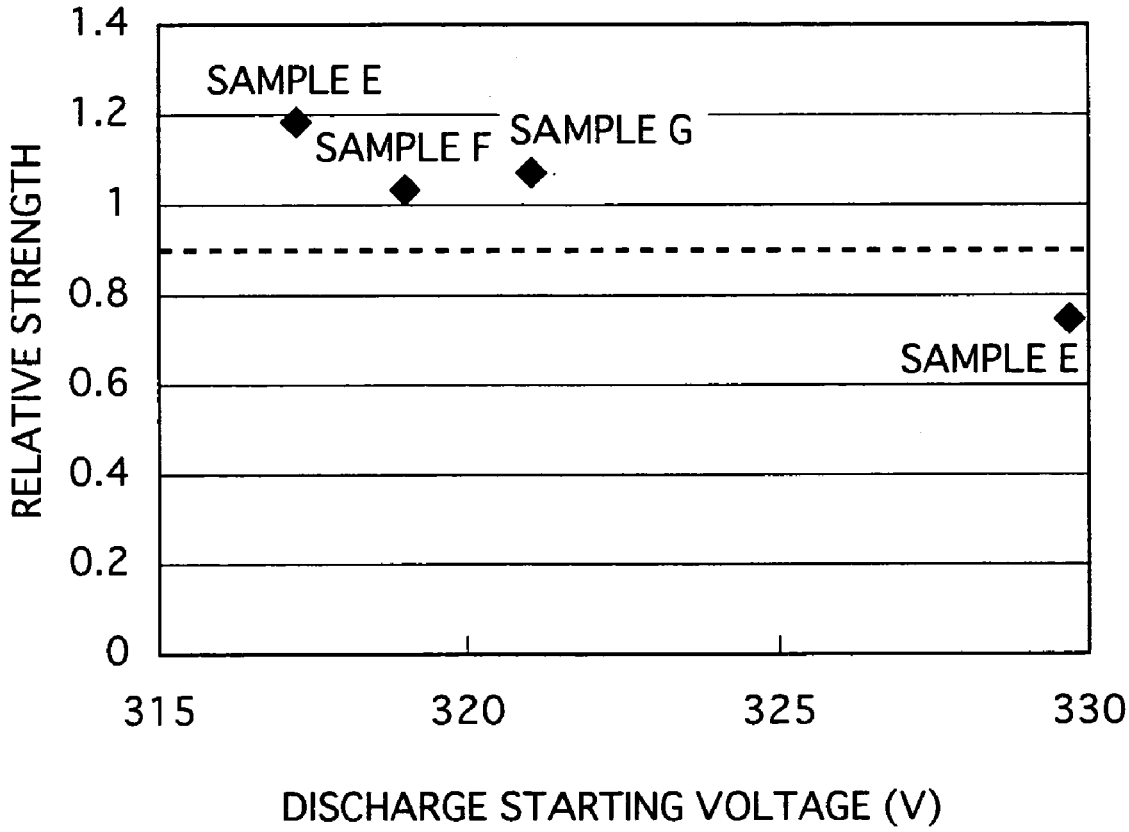
FIG. 8 is a graph showing a relation between discharge starting voltage and light emission intensity in cathodoluminescence spectroscopy.
Figure 9:
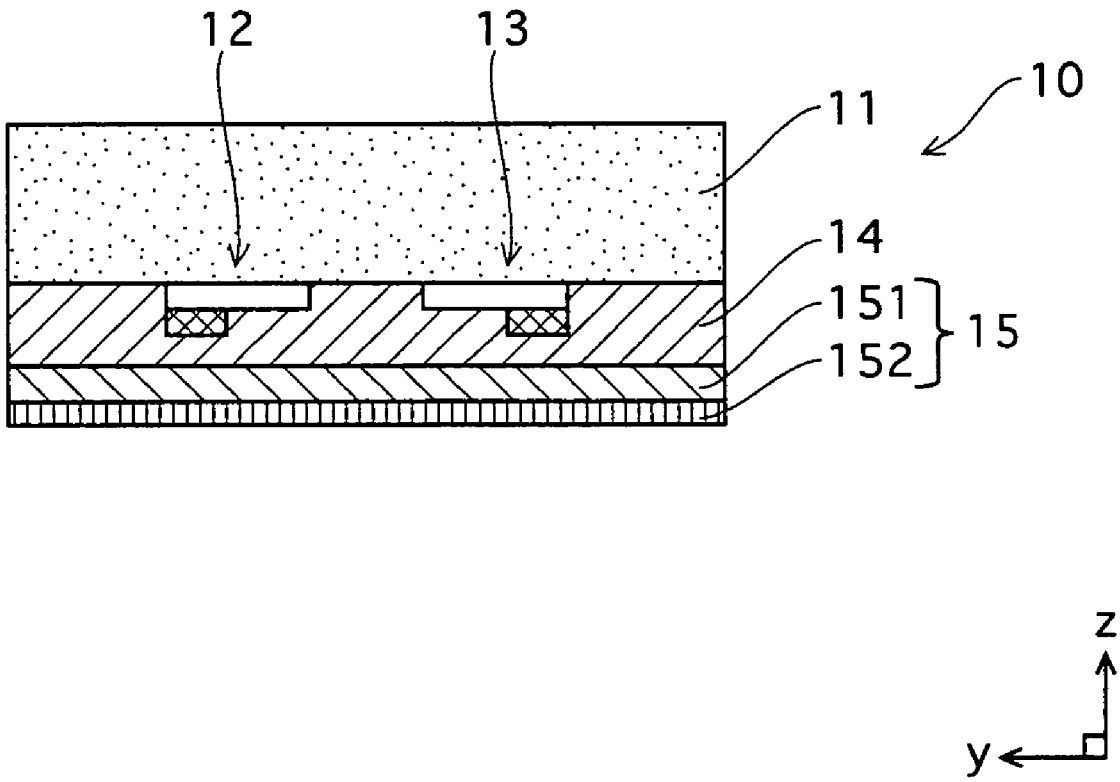
FIG. 9 is a sectional conceptual diagram showing a structure around a protective layer of a PDP according to the second embodiment.
Figure 10A:
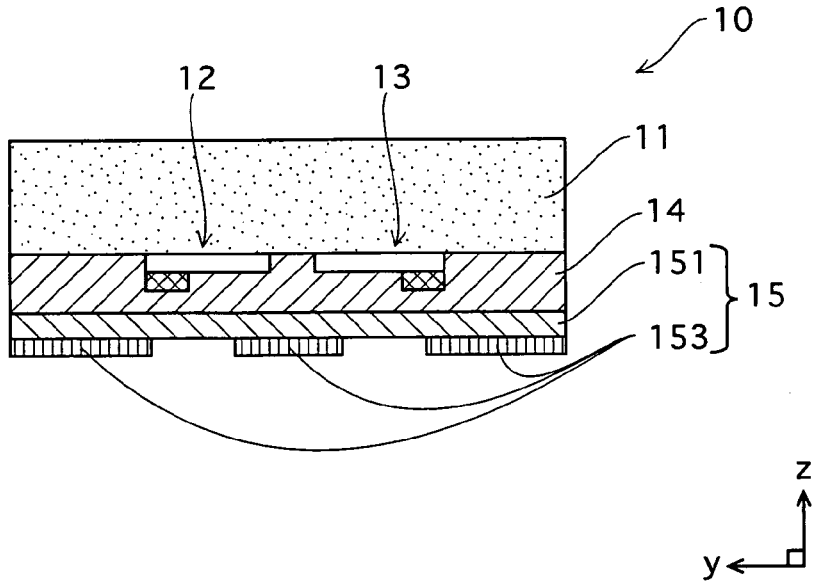
FIG. 10A is a sectional conceptual diagram showing a structure of a discharge cell around a front panel according to the second embodiment.
Figure 10B:
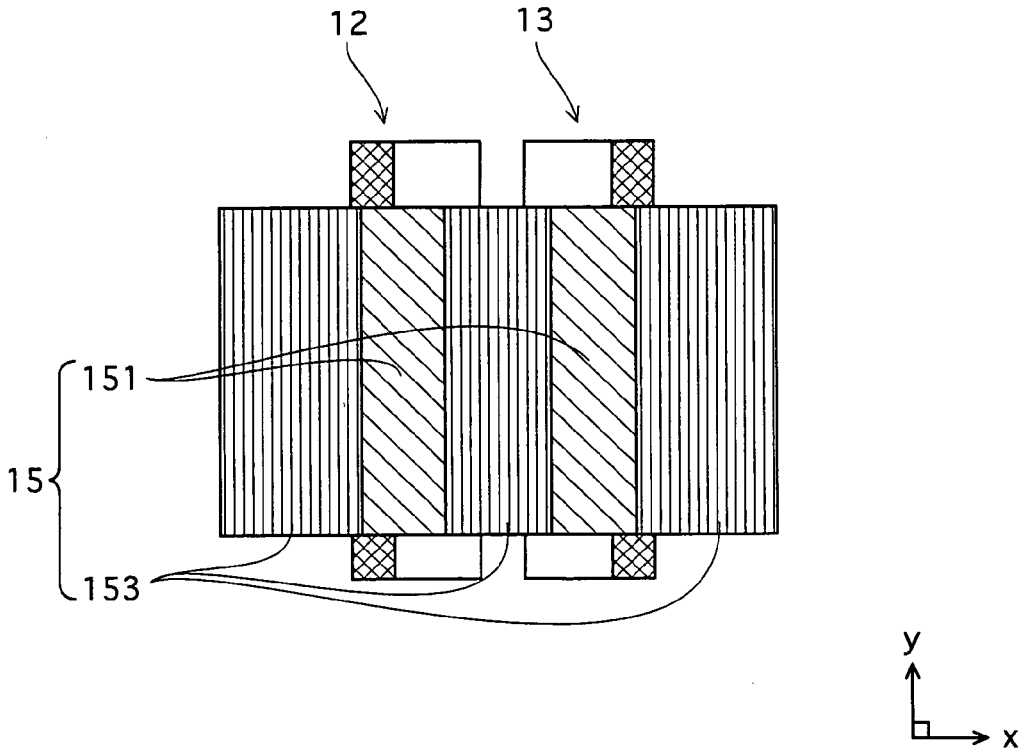
FIG. 10B is a plan conceptual diagram of FIG. 10A.
Figure 11A:
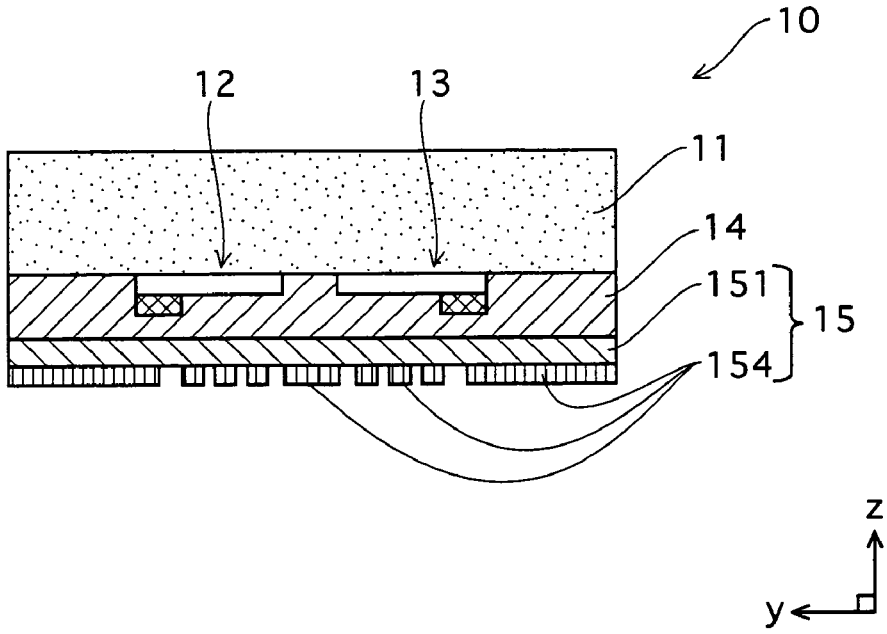
FIG. 11A is a sectional conceptual diagram showing a structure regarding a front panel in another embodiment example according to the second embodiment.
Figure 11B:
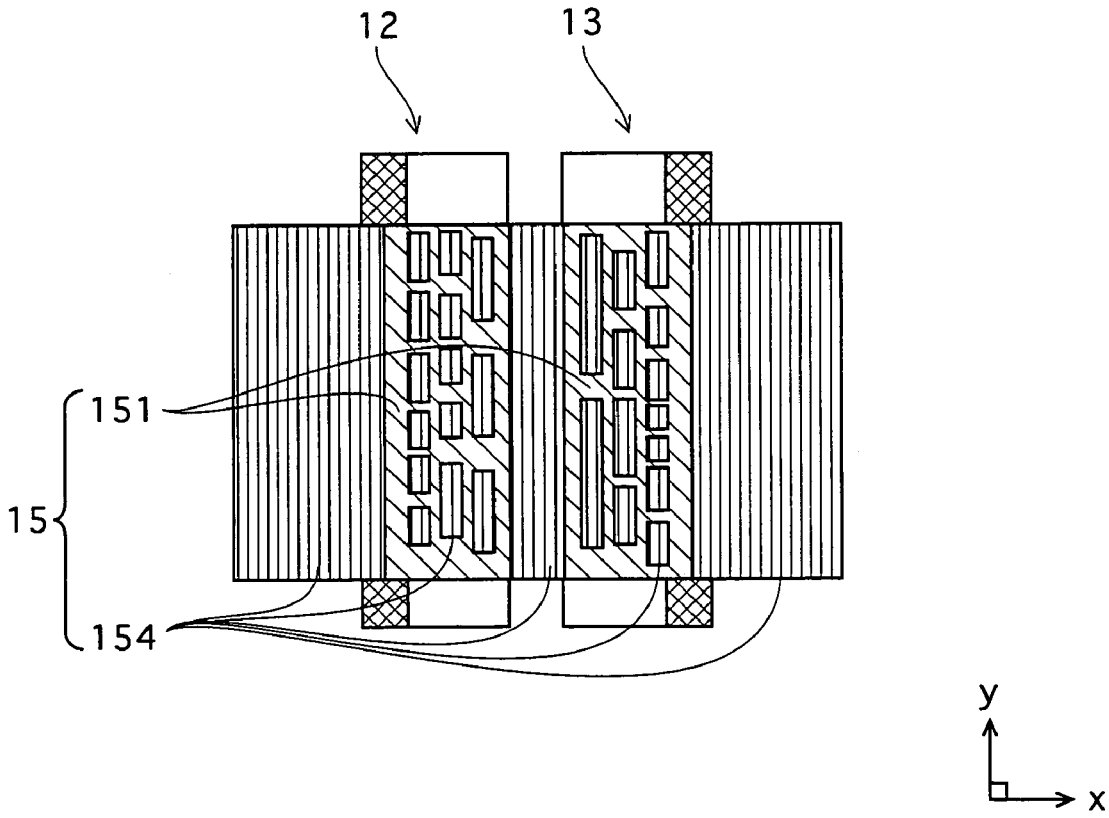
FIG. 11B is a plan conceptual diagram of FIG. 11A.
Figure 12:
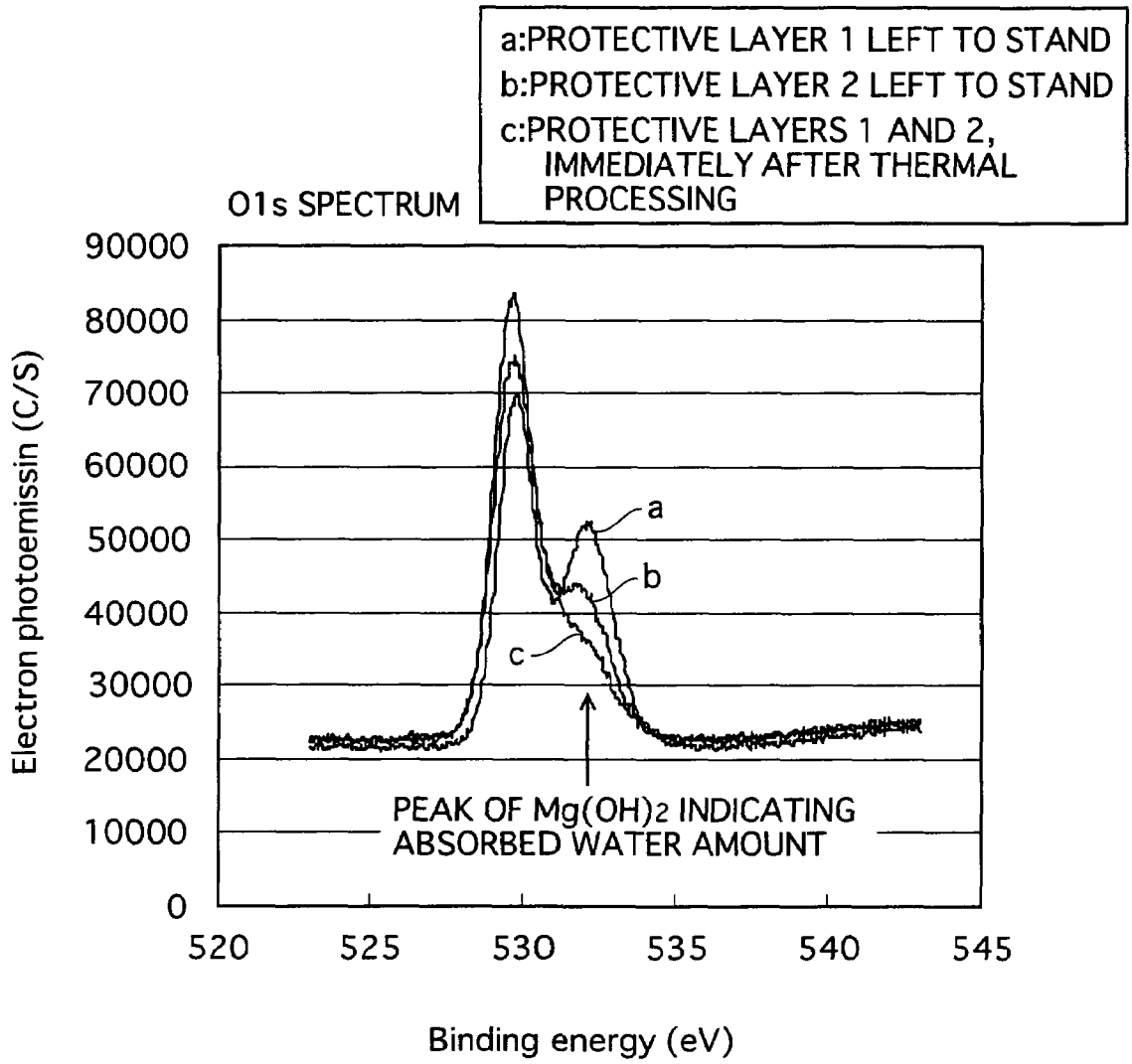
FIG. 12 is a diagram showing a difference of absorption amount when leaving a protective layer to stand.

1 PDP
10 front panel
11 front panel glass
12 scan electrode
13 sustain electrode
14,19 dielectric layer
15 protective layer
16 back panel
17 back panel glass
18 address electrode
20 barrier rib
23 phosphor layer
31,32 discharge cell

33 display electrode
34,35,36,37 protective layer
121,131 bus electrode
151,152 first protective film
153,154 second protective film

The invention claimed is:

1. A gas discharge display panel comprising a substrate, a dielectric layer, and a protective layer, the dielectric layer and the protective layer being formed in the stated order on a surface of the substrate, wherein:

the protective layer contains Ge in a range of 10 mass ppm to 300 mass ppm inclusive and further contains H in a range of 1000 mass ppm to 2000 mass ppm inclusive with respect to a MgO content of the protective layer.

2. The gas discharge display panel of claim 1, wherein the Ge content of the protective layer is in a range of 20 mass ppm to 100 mass ppm with respect to the MgO content.

* * * * *